US006417511B1

(12) United States Patent
Russ, IV et al.

(10) Patent No.: US 6,417,511 B1
(45) Date of Patent: Jul. 9, 2002

(54) RING POLE ION GUIDE APPARATUS, SYSTEMS AND METHOD

(75) Inventors: Charles W. Russ, IV, Sunnyvale; Steven M. Fischer, Hayward, both of CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/617,877

(22) Filed: Jul. 17, 2000

(51) Int. Cl.[7] ..... H01J 49/00
(52) U.S. Cl. ..... 250/292; 250/396 R
(58) Field of Search ..... 250/292, 396 R

(56) References Cited

U.S. PATENT DOCUMENTS

| | | | | | |
|---|---|---|---|---|---|
| 4,234,791 | A | | 11/1980 | Enke et al. | 250/281 |
| 4,464,573 | A | * | 8/1984 | Dalglish | 250/396 R |
| 5,021,670 | A | * | 6/1991 | Lanio et al. | 250/396 R |
| 5,248,875 | A | | 9/1993 | Dougla et al. | 250/282 |
| 5,291,016 | A | * | 3/1994 | Taya | 250/292 |
| 5,652,427 | A | | 7/1997 | Whitehouse et al. | 250/288 |
| 5,708,268 | A | | 1/1998 | Franzen | 250/292 |
| 5,847,386 | A | | 12/1998 | Thomson et al. | 250/288 |
| 5,962,851 | A | | 10/1999 | Whitehouse et al. | 250/288 |
| 6,107,623 | A | * | 8/2000 | Bateman et al. | 250/282 |
| 6,163,032 | A | * | 12/2000 | Rockwood | 250/396 R |
| 6,331,702 | B1 | * | 12/2001 | Krutchinsky et al. | 250/281 |

FOREIGN PATENT DOCUMENTS

| | | | |
|---|---|---|---|
| WO | WO 97/07530 | 2/1997 | H01J/49/42 |

OTHER PUBLICATIONS

Shenheng Guan and Alan G. Marshall, "Stacked–Ring Electrostatic Guide," J AM Soc Mass Spectrom, 1996, 7, pp.101–106.

D. J. Douglas and J. B. French, "Collisional Focusing Effects in Radio Frequency Quadrapoles," J Am Soc ass Spectrom, 1992, 3, pp. 398–408.

A.V. Tolmachev, et al, "A Collisional Focusing Ion Guide for Coupling an Atmosoheric Pressure Ion Source to a Mass Spectrometer," Nucl. Instr. and Meth. in Phys. Res. B, 124, 1997, pp. 112–119.

Scott Shaffer, et al., "An Ion Funnel Interface for Improved Ion Focusing and Sensitivity Using Electrospray Ionization Mass Spectrometry," Anal. Chem., 1998, 70, pp. 4111–4119.

J. Franzen, et al., "Electrical Ion Guides," ASMS, 1996, p. 1170.

* cited by examiner

*Primary Examiner*—Kiet T. Nguyen

(57) ABSTRACT

A ring pole ion guide apparatus and method provide the focusing and confinement advantages of conventional multipoles and the axial field of a conventional DC ring guide all in one device. The ring pole apparatus comprises a ring stack portion and a multipole portion, wherein the ring stack portion essentially overlaps the multipole portion inside and outside along a central axis. The ring pole apparatus can be used in a mass spectrometer system to guide ions from the ion source to the mass spectrometer or between mass spectrometer stages, or to dissociate ions into daughter ions in an ion dissociation system. A single ring pole ion guide can span a plurality of pressure transition stages with several of the rings acting as pressure partitions.

66 Claims, 17 Drawing Sheets

RING POLE ION GUIDE APPARATUS, SYSTEMS AND METHOD

TECHNICAL FIELD

This invention relates to mass spectrometry. In particular, the invention relates to an ion beam guide apparatus, systems and method for use in mass spectrometry.

BACKGROUND ART

Mass spectrometry is an analytical methodology used for quantitative elemental analysis of materials and mixtures of materials. In mass spectrometry, a sample of a material to be analyzed, called an analyte, is broken into particles of its constituent parts and some of the particles are given an electric charge. Those particles, referred to hereinbelow as analyte ions, are typically molecular in size. Once produced, the analyte ions are separated by the spectrometer based on their respective masses. The separated analyte ions are then detected and a "mass spectrum" of the material is produced. The mass spectrum is analogous to a fingerprint of the sample material being analyzed. The mass spectrum provides information about the masses and in some cases the quantities of the various analyte particles that make up the sample. In particular, mass spectrometry can be used to determine the molecular weights of molecules and molecular fragments within an analyte. Additionally, mass spectrometry can identify components within the analyte based on the fragmentation pattern when the material is broken into particles. Mass spectrometry has proven to be a very powerful analytical tool in material science, chemistry and biology along with a number of other related fields.

Many forms of mass spectrometry produce analyte ions at relatively high pressures compared to the pressures extant in other portions of the mass spectrometer. For example, Atmospheric Pressure Matrix Assisted Laser Desorption Ionization (AP-MALDI), Field Asymmetric Ion Mobility Spectrometry (FAIMS), Atmospheric Pressure Ionization (API, including its subsets, such as Electrospray Ionization (ESI) and Atmospheric Pressure Chemical Ionization (APCI)), and Inductively Coupled Plasma (ICP) mass spectrometry, are a few forms of mass spectrometry using high pressures for ionization that are known in the art. All of these mass spectrometric methods generate ions at or near atmospheric pressure (760 Torr). Once generated, the analyte ions must be introduced or sampled into the mass spectrometer. Typically, the interior portions of a mass spectrometer are maintained at high vacuum levels ($<10^{-4}$ Torr) or even ultra-high vacuum levels ($<10^{-7}$ Torr). In practice, sampling the ions requires transporting the analyte ions in the form of a narrowly confined ion beam from the ion source to the high vacuum mass spectrometer chamber by way of one or more intermediate vacuum chambers. Each of the intermediate vacuum chambers is maintained at a vacuum level between that of the proceeding and following chambers. Therefore, the ion beam transporting the analyte ions transitions in a stepwise manner from the pressure levels associated with ion formation to those of the mass spectrometer.

At interfaces between each chamber, the ion beam passes from one chamber to the next through small apertures or orifices. The apertures are small enough that each of the intermediate vacuum chambers can maintain the desired vacuum level using a vacuum pump in spite of gas leakage that occurs between chambers at the aperture.

To be effective in mass spectrometer application, the ion beam must be able to transport the analyte ions through each of the intermediate vacuum chambers and into the mass spectrometer without significant loss of ions. Loss of ions typically occurs due to interaction with gas molecules inside the intermediate vacuum chambers. While the ion beam is passing through the intermediate vacuum chamber, analyte ions can and do collide with gas molecules present causing the ions to be slowed down or "stalled out". Ions that are sufficiently slowed by this interaction will tend to drift to the walls of the intermediate vacuum chambers where they are "trapped" and subsequently lost from the beam.

Even if significant ion loss does not occur, the interaction between analyte ions of the beam and gas molecules present in the intermediate vacuum chambers can also cause the beam to widen or to spread. If the beam is widened too much, the number of analyte ions that will ultimately pass through the aperture at an output end of the chamber will be reduced by an unacceptable amount. Therefore, ion beams that carry the analyte ions through intermediate vacuum chambers are generally transported using "ion guides". The use of ion guides is primarily intended to minimize the loss of ions being transported and to control the ion beam volumetric and energy characteristics.

Ion guides are devices that utilize electromagnetic fields to confine the ions radially (x and y) while allowing or even promoting ion transport axially (z). Franzen, "Electrical Ion Guides", 1996 *ASMS Conference Proceedings,* p 1170 provides a short overview of the two principal types of electrical ion guides: the electrodynamic ion guides and the electrostatic ion guides. Electrodynamic ion guides employ repellent inhomogeneous radio frequency (RF) fields to create electric pseudo-potential wells to confine the analyte ions as they travel through the guide. Common electrodynamic type ion guides include for example, RF multipoles and ring stacks. Electrostatic ion guides utilize attracting forces around a thin wire or similar mechanism to control the motion of the analyte ions in the guide.

In addition to controlling the ion beam during transport, it is often necessary to reduce the phase space volume of the ion beam at certain points during transport. Phase space volume refers to a six dimensional space of x, y and z position and x, y and z momentum. An example of this is the need to reduce the beam diameter to maximize its transmission through small diameter apertures in the vacuum chamber interfaces. Beam diameter reduction may require "collisional focusing" and/or "collisional cooling" of the ion beam. Collisional focusing/cooling is generally accomplished with the ion guide at elevated pressures.

Collisional focusing is the use of repeated collisions of ions with neutral molecules in a suitably confining electromagnetic field, thereby reducing the radial position and/or energy of the beam. That is, the ions are focused into a smaller, more parallel beam. For more information about collision focusing see, for example, D. J. Douglas and J. B. French, "Collision Focusing Effects in Radio Frequency Quadrupoles", *J. Am. Soc. Mass Spectrom.,* 3 (1992) pp. 398–408.

Collisional cooling is the use of repeated collisions of ions with neutral molecules to retard the average axial energy of the ion beam and to narrow its distribution. In other words, the beam has a lower, more uniform axial energy. To a first order, the number of collisions an ion is subjected to is dependent on the "collision cross section" of the ion and the "gas thickness". Collision cross section is the effective area for scattering or reaction between two specified particles. Gas thickness is the product of neutral gas density and ion path length.

Generally it takes considerably more collisions to focus a beam than to cool it. It takes higher neutral gas density or longer ion path length to focus or cool ions with small cross sections. And further, it takes more collisions to cool or focus ions with larger masses. Thus, a complicated situation may result where the neutral gas pressure that yields a gas thickness high enough to guarantee adequate cooling and/or focusing of all ions may be too high for many of the ions involved. In other words, some ions, particularly low mass ions, may be overly cooled and can become "trapped" or have their axial velocities reduced below a practical or preferable level.

Also, it is sometimes desirable or even necessary to perform several stages of ionization with intermediate mass spectrometric stages, generically referred to as "MS/MS". In one common implementation, called a "Triple Quad", molecules are ionized (creating the "parent" ions), mass-filtered, fragmented (creating the "daughter" ions) and mass-filtered again. The fragmentation takes place in a "collision cell". The collision cell is a chamber between adjacent mass spectrometers with significant gas thickness and energy to fragment the analyte ions through collisions with neutral gas particles within the fragmentation cell. The fragmentation in the collision cell requires the simultaneous confinement, transport, and focusing of both parent and daughter ions to the next mass spectrometer. The term "parent ion" refers to the analyte ion prior to fragmentation and the term "daughter ion" refers to the resulting ions produced by the fragmentation. Since different ions will have different ionization cross sections, a pressure high enough to ensure fragmentation of all ions may lead to excessive cooling of lighter ions. On the other hand, very high axial energies (100 eV) may be required for fragmentation. If there is not significant subsequent cooling, the exiting beam may have a very broad distribution of axial energies leading to sub-optimal performance in the final mass spectrometer. Moreover, parent and daughter ions will have different cross sections and masses from each other that must be accommodated by the pressure chosen. All of these circumstances may require that the cell pressure be set higher than one might otherwise choose, causing some ions to stall out.

Thus, there is a need for devices that simultaneously transport, confine, focus and cool an ion beam while still maintaining sufficient axial energy. Such devices require adding axial energy, or accelerating the analyte ions, through an axial field. The addition of axial energy through an axial field must be achieved in such a manner that the axial energy is not high enough to cause fragmentation. There are many techniques known in the art to add axial energy through an axial field. U.S. Pat. No. 5,847,386 and the related PCT application no. WO 97/07530 of Thomson et al. describe some of these techniques and devices.

The RF multipole is one type of such devices described by Thompson et al. FIGS. 1A–1C illustrate various conventional RF multipoles. The RF multipoles require only two RF voltages, provide focusing and have an effective-potential well that can be tailored using multipole terms. FIG. 1A illustrates a conventional quadrupole while FIGS. 1B and 1C illustrate a hexapole and an octupole respectively. An RF voltage applied to the four axially oriented conductive rods that make up the quadrupole produces an inhomogeneous RF field between the rods. The magnitude of the field is greatest in the vicinity of the rods and minimum at a center point equal distance from the rods. The oscillation of the analyte ions in the presence of the RF field tends to move the ions down the RF gradient and towards the minimum field point or potential well. The movement of the ions along the gradient has given rise to the notion of a psuedo-potential force on the ions. See, for example, Tolmachev et al., "A Collisional Focusing Ion Guide for Coupling an Atmospheric Pressure Ion Source to a Mass Spectrometer", *Nucl. Instr. Meth. In Phys. Res., B* 124 (1997) 112–119 and S. Guan and A. G. Marshall, "Stacked-Ring Electrostatic Ion Guide", *J. Am. Soc. Mass Spectrom.,* 7 (1996) 101–106. However, the RF multipoles provide no intrinsic axial acceleration. To achieve axial acceleration, tapered or splayed rods; a voltage drop across resistive rods, resistive helper rods, or external rings; or axial segmentation of the multipoles may be used.

S. Guan and A. G. Marshall, cited supra, describe another device, the ring guide. FIG. 2 illustrates this alternative to the RF multipole ion guide also known as the conventional stacked-ring ion guide. Unlike the RF multipole, the stacked ring guide is an electrostatic ion guide and does not require an RF voltage source. The stacked ring guide imparts an axial acceleration by stepping the voltage down from one ring to another. However, the stacked ring guide provides little or no focusing, requires very fine spacing of many electrodes and requires many voltage sources or values to achieve simultaneous confinement and acceleration of the ions. In addition, the stacked ring guide is sensitive to the axial energy of the ions entering the guide and is known to suffer from axial trapping of ions.

FIG. 3 illustrates yet another alternative to the RF multipole ion guide known as a conventional ion funnel. The ion funnel is an improvement on the ring guide and provides some focusing. See, for example, Shaffer et al., "An Ion Funnel Interface for Improved Ion Focusing and Sensitivity Using Electrospray Ionization Mass Spectrometry", *Anal. Chem.,* 70 (1998) 4111–4119, and Shaffer et al, PCT WO 97/49111. However, the ion funnel generally requires even more electrodes and voltages, including RF voltages. Moreover, the ion funnel traditionally has trouble transmitting low mass ions (<200 AMU), severely limiting its usefulness for many mass spectrometry applications.

Thus, it would be advantageous to have an ion guide device and method that combine the benefits of the many conventional ion guides and techniques but do not have all the disadvantages associated with the conventional ion guides and techniques. Such an ion guide device and method would transport the analyte ions without significant loss through its ability to confine the ion beam. Further, such an ion guide and method would maintain some minimal level of axial velocity of the analyte ions through its ability to accelerate the ions by way of an axially oriented potential gradient. Such a device and method would not only have wide applicability but could be lower in cost and higher in reliability than conventional ion guides and methods.

SUMMARY OF THE INVENTION

The present invention provides a novel ion transport apparatus and method that can be used in mass spectrometry. The ion transport apparatus and method comprise a ring stack that extends inside a multipole. The apparatus and method achieve the focusing and confinement advantages of a conventional RF multipole and the advantage of an axial field of a conventional stacked ring guide or ion funnel. However, since the ring stack of the present invention is not used to establish a confining, effective-potential well, the ring spacing of the present apparatus can be greater than that of a conventional ring guide or ion funnel. As a result, the number of electrodes or rings and the corresponding number of voltages needed are reduced compared to the conventional ring guides. In addition, no RF is required on the rings in contrast to the ion funnel.

In one aspect of the invention, a ring pole ion guide apparatus is provided that comprises a multipole portion and a ring stack portion, wherein the ring stack portion extends inside the multipole portion. For the purposes of this invention, the ring pole ion guide apparatus is also referred to herein as the "ring pole" device, apparatus or guide to distinguish it from the conventional ring stack devices and the RF multipole devices.

In another aspect of the invention, a method of transporting ions using the ring pole ion guide apparatus described above is provided. After the ions are introduced into the input end of the ion guide, the method of transporting ions comprises the steps of focusing the ions by applying an RF field with the multipole portion, and accelerating the ions by applying a DC electric field with the ring stack portion. The ions are ejected from an output end.

In still another aspect of the invention, a mass spectrometer system is provided that utilizes the ring pole ion guide apparatus and method described above instead of conventional ion guides and techniques. The mass spectrometer system of the invention comprises the conventional components of a mass spectrometer system, such as an ion source, a mass analyzer, an ion detector system, and further comprises the ring pole ion guide apparatus of the present invention.

In another aspect of the invention, the ring pole ion guide apparatus is made longer to traverse several pressure transition stages in the mass spectrometer system. Several of the rings on the ring pole apparatus act as pressure partitions between adjacent pressure stages.

In still another aspect of the invention, the ring pole ion guide apparatus may be used in a collision cell or a system for dissociating ions. When used in the ion dissociation system of the present invention, the ring pole ion guide provides improved performance compared to conventional ion guides.

BRIEF DESCRIPTION OF THE DRAWINGS

The various features and advantages of the present invention may be more readily understood with reference to the following detailed description taken in conjunction with the accompanying drawings, where like reference numerals designate like structural elements, and in which:

FIGS. 5C–5G illustrate side views of non-parallel rod relationships according to other embodiments of the present invention.

MODES FOR CARRYING OUT THE INVENTION

Figure 1A:
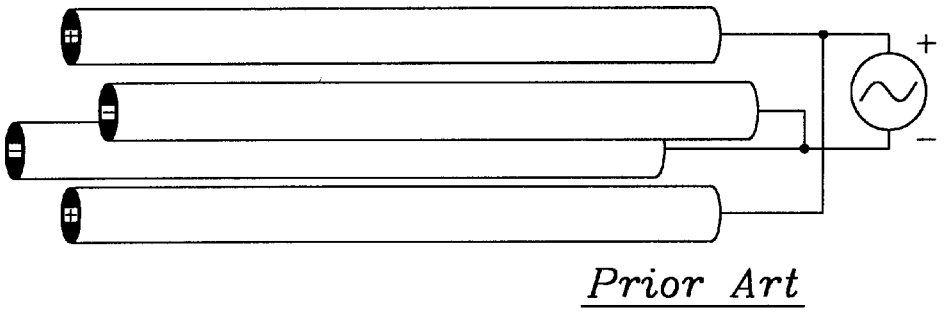
FIGS. 1A–1C illustrate conventional RF multipole ion guides of the prior art.
Figure 1B:
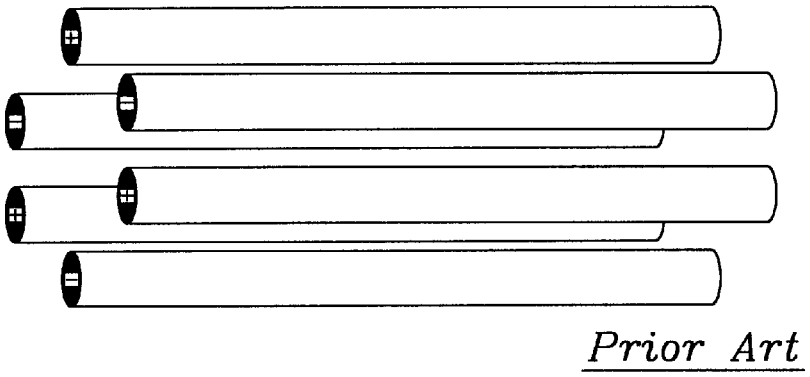
Figure 1C:
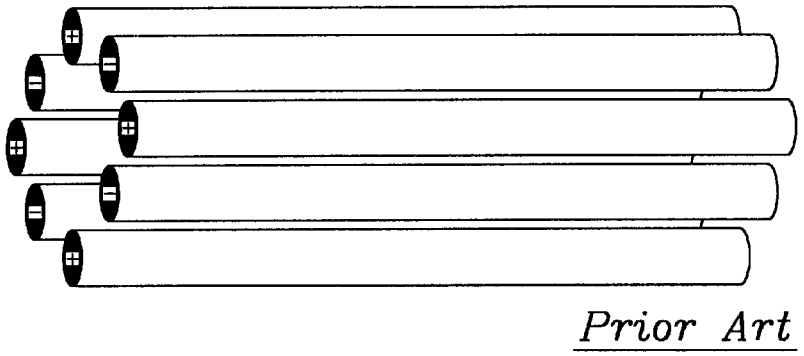
Figure 2:
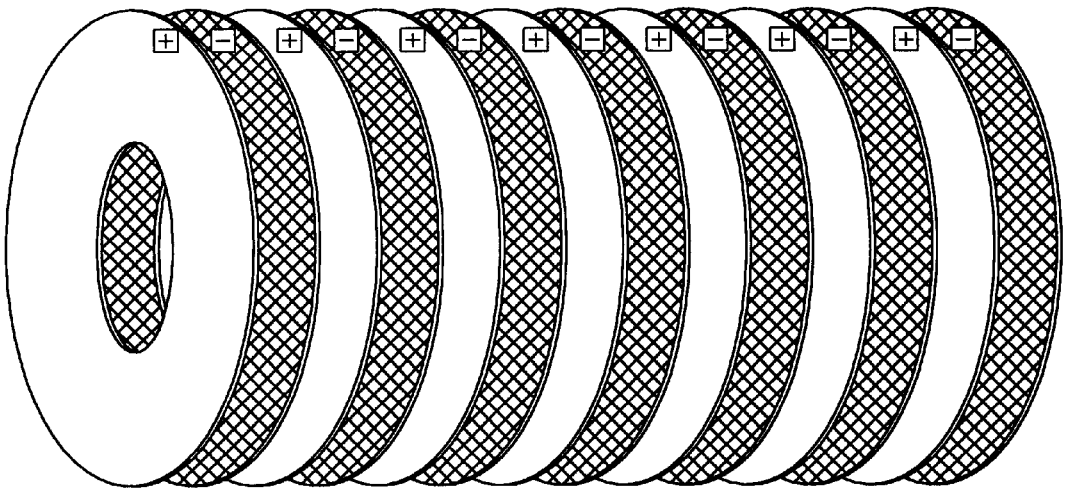
Prior Art FIG. 2
FIG. 2 illustrates a conventional stacked ring guide of the prior art.
Figure 3:
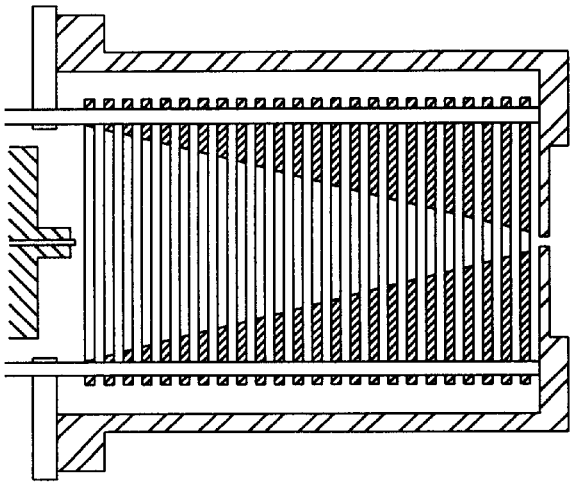
Prior Art FIG. 3
FIG. 3 illustrates a conventional ion funnel of the prior art.
Figure 4:
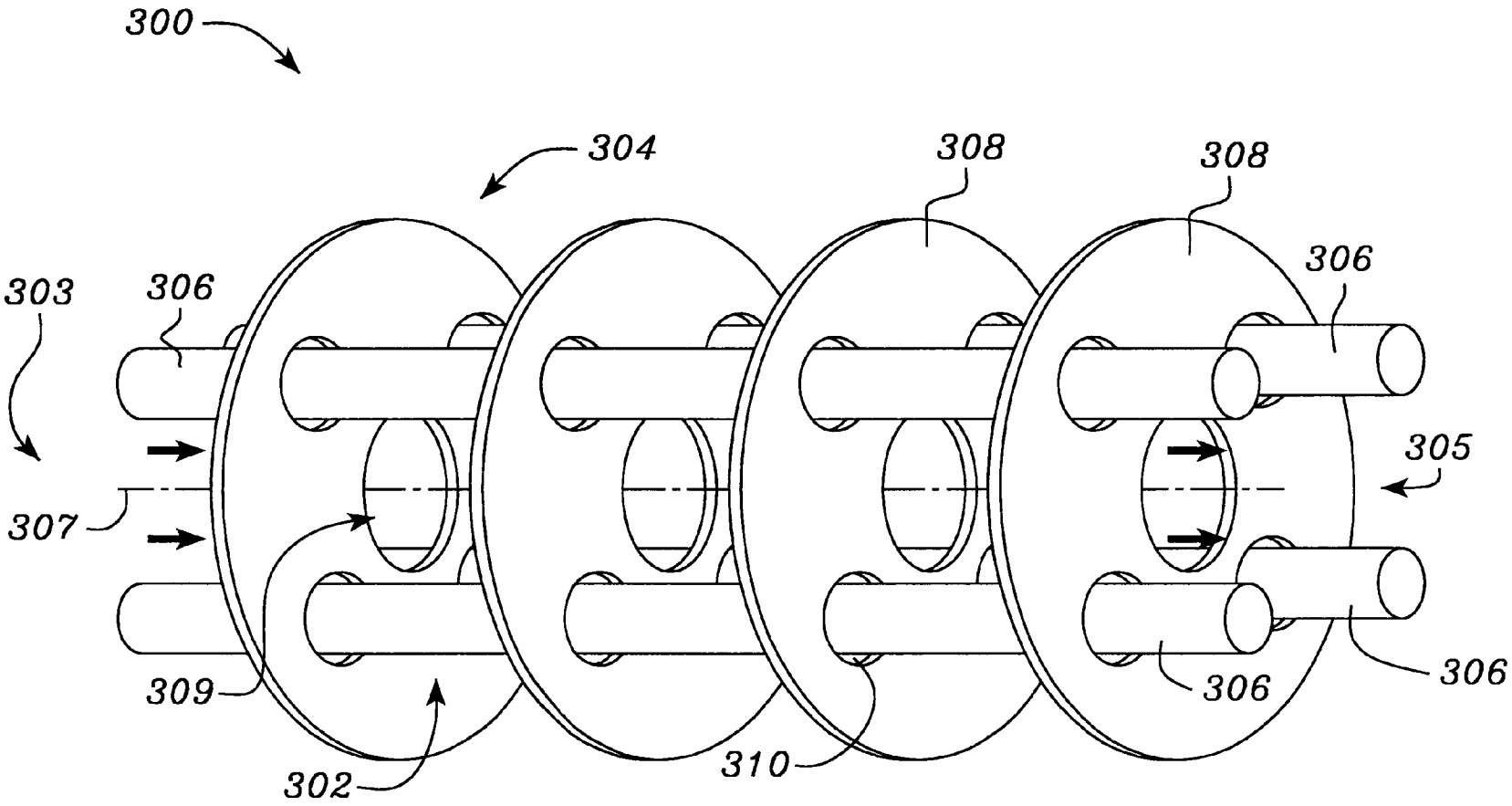
FIG. 4 illustrates a perspective view of the ring pole ion guide apparatus of the present invention.
Figure 6A:
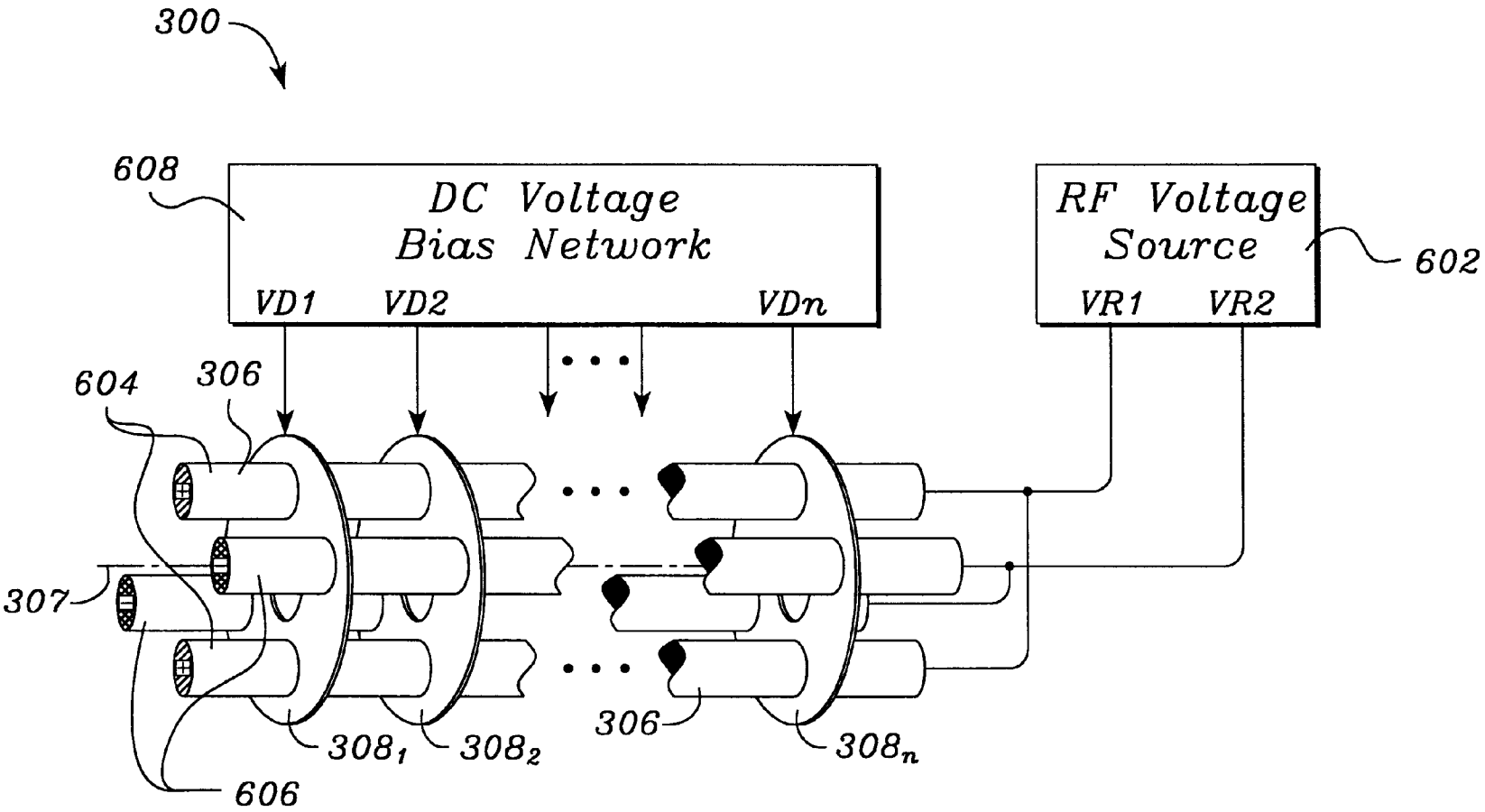
FIG. 6A illustrates a schematic view of the interconnection of the RF voltage source and the DC voltage bias network to the ring pole ion guide of the present invention.

The ion transport apparatus 300 of the present invention is illustrated in FIG. 4. The ring pole ion guide 300 comprises a multipole portion 302 and a ring stack portion 304 and has an input end 303 for accepting analyte ions and an output end 305. The ring stack portion 304 extends inside and outside the multipole portion 302, thereby essentially overlapping the multipole portion 302. A radio frequency (RF) power source 602 is applied to the multipole portion 302 while a direct current (DC) source 608 is applied to the ring stack portion 304, as illustrated in FIG. 6A. The RF power source 602 produces an RF electromagnetic field that functions to "guide" or compress the analyte ions toward a generally centrally located longitudinal axis 307 ("hereinafter "central axis 307") of the ring pole ion guide 300. The analyte ions, under the influence of the RF power source 602, travel through the ring pole ion guide 300 in a collimated trajectory known as a "beam". The DC source 608 produces an axial electric field that imparts an accelerating force to the analyte ions. The axial field essentially "pushes" the ions in the transport direction (shown with solid arrows in FIG. 4) along the central axis 307. Therefore, the multipole portion 302 and its associated RF power source 602 operate in conjunction with the ring stack portion 304 and its associated DC power source 608 to simultaneously guide and transport analyte ions from the input end 303 to the output end 305 of the ring pole ion guide 300 of the present invention.

The multipole portion 302 comprises a plurality of rods or poles 306 that are grouped together in a spaced apart relationship. The rods 306 may be either parallel or nonparallel to the central axis 307. Further, the rods 306 may have a parallel portion and/or a nonparallel portion. Still further, the central axis 307 may be linear or nonlinear, or may have a linear portion and/or a nonlinear portion, as is further described below. The rods 306 are preferably each parallel to and at an approximately equal radial distance from the central axis 307 of the ring pole ion guide 300.

Figure 5A:
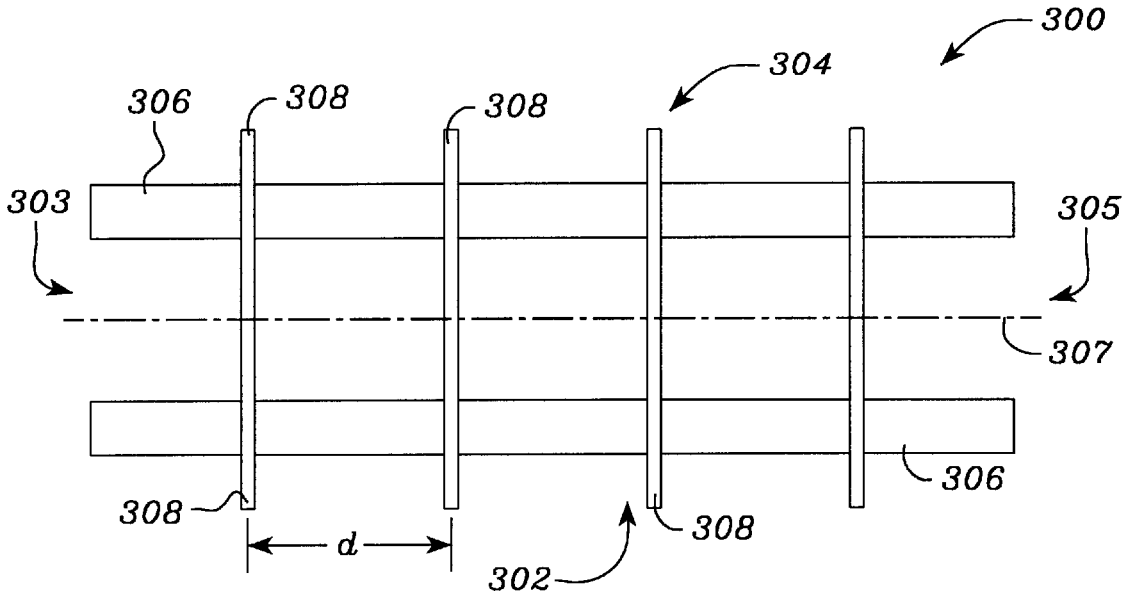
FIG. 5A illustrates a side view of the ring pole ion guide of the preferred embodiment of the present invention.
Figure 5B:
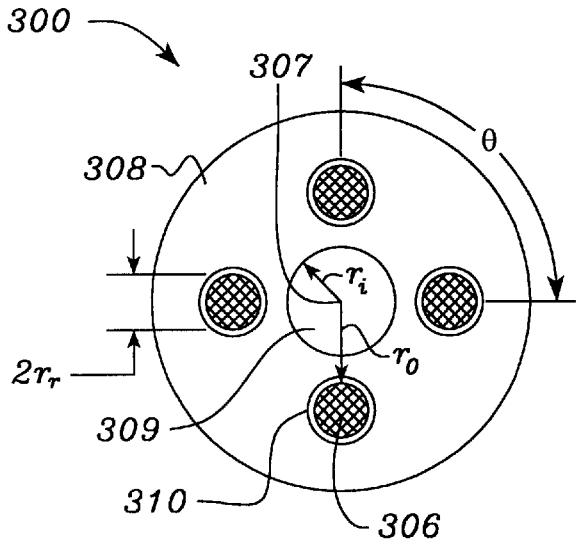
FIG. 5B illustrates an end view of the ring pole ion guide of FIG. 5A.

Referring to FIG. 5A, a side view of the ring pole device 300 of the present invention is illustrated. FIG. 5B illustrates an end view of the ring pole device 300. FIGS. 4 and 5A illustrate a ring pole guide 300 embodiment with four parallel rod 306 and a linear central axis 307. As illustrated in FIGS. 5A and 5B, the inscribed radius of the rods 306 is $r_0$. As used herein, the inscribed radius $r_0$ is the radius of a circle that fits between, and is approximately tangent to the outer surfaces of, the rods 306. The central axis 307 defines the nominal path of analyte ions that are transported by the ion transport apparatus 300 of the present invention. In typical applications, the inscribed radius $r_0$ can range from 1 mm to 10 mm, and preferably about 3.25 mm. However, it is within the scope of the invention for functional ion guides to be built with an inscribed radius $r_0$ that is significantly outside this range. For example, for nonparallel rods, the inscribed radius $r_0$ will vary along the central axis 307. Thus, it is not the intent of the inventors to be limited to any value or range of values for the inscribed radius $r_0$ of the rods 306 for the ion guide 300 of the invention.

Additionally, the rods 306 are disposed about the central axis 307 such that there is an angular center-to-center separation θ between each of the rods 306. Preferably, the angular separation θ between rods 306 is approximately equal. The multipole portion 302 of the present invention can comprise any number of rods 306, preferably equal to or greater than four (4) rods 306. As is described further below, there are preferably four (4) to thirty-two (32) rods 306 in the multipole portion 302 of the present invention. When the multipole portion 302 has four rods, called a quadrupole, the nominal angular separation θ is ninety degrees. Similarly, when the multipole portion 302 has six rods, called a hexapole, the angular separation θ would be sixty degrees. Moreover, the rods 306 extend from the input end of the ring pole ion guide 300 to the output end 305 through which the analyte ions exit the ring pole ion guide 300.

Figure 5C:
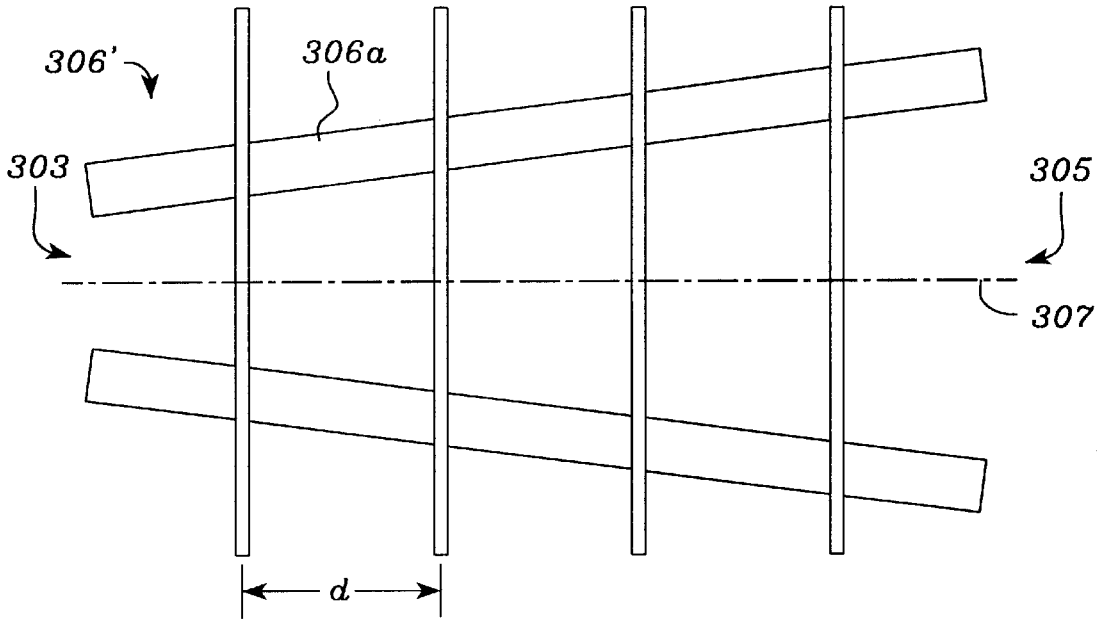
Figure 5D:
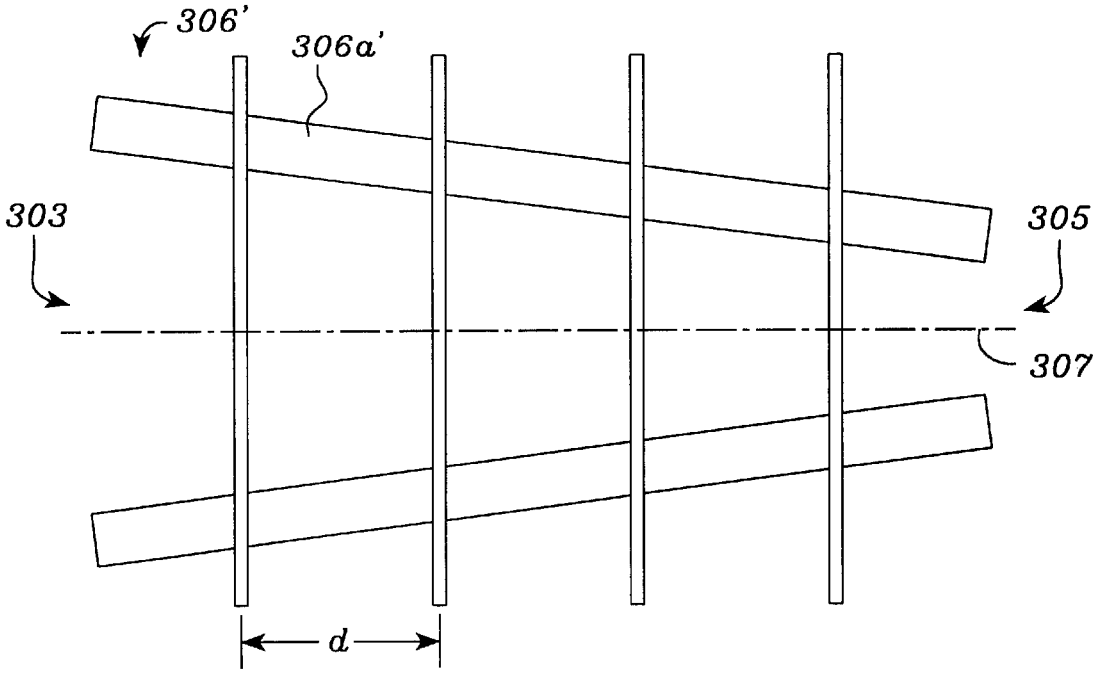
Figure 5E:
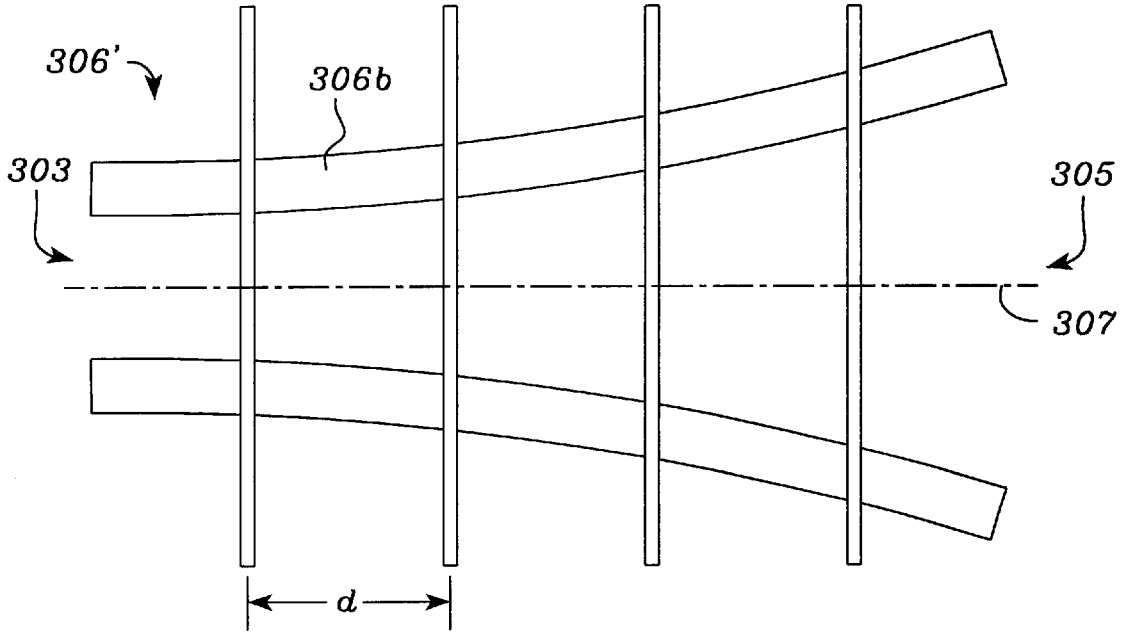
Figure 5F:
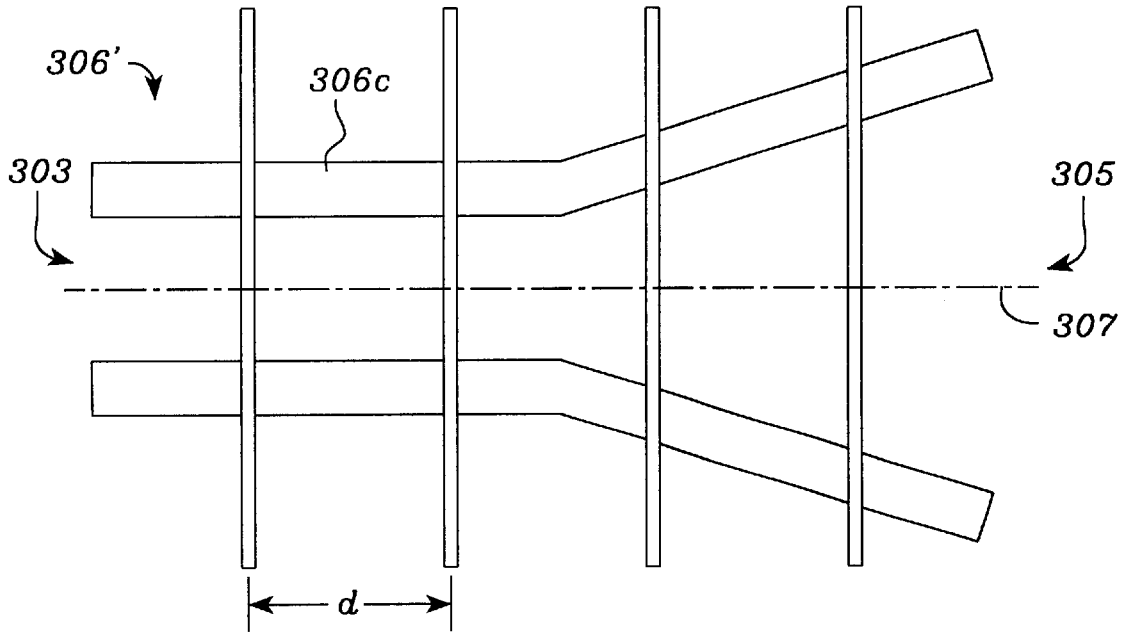
Figure 5C:
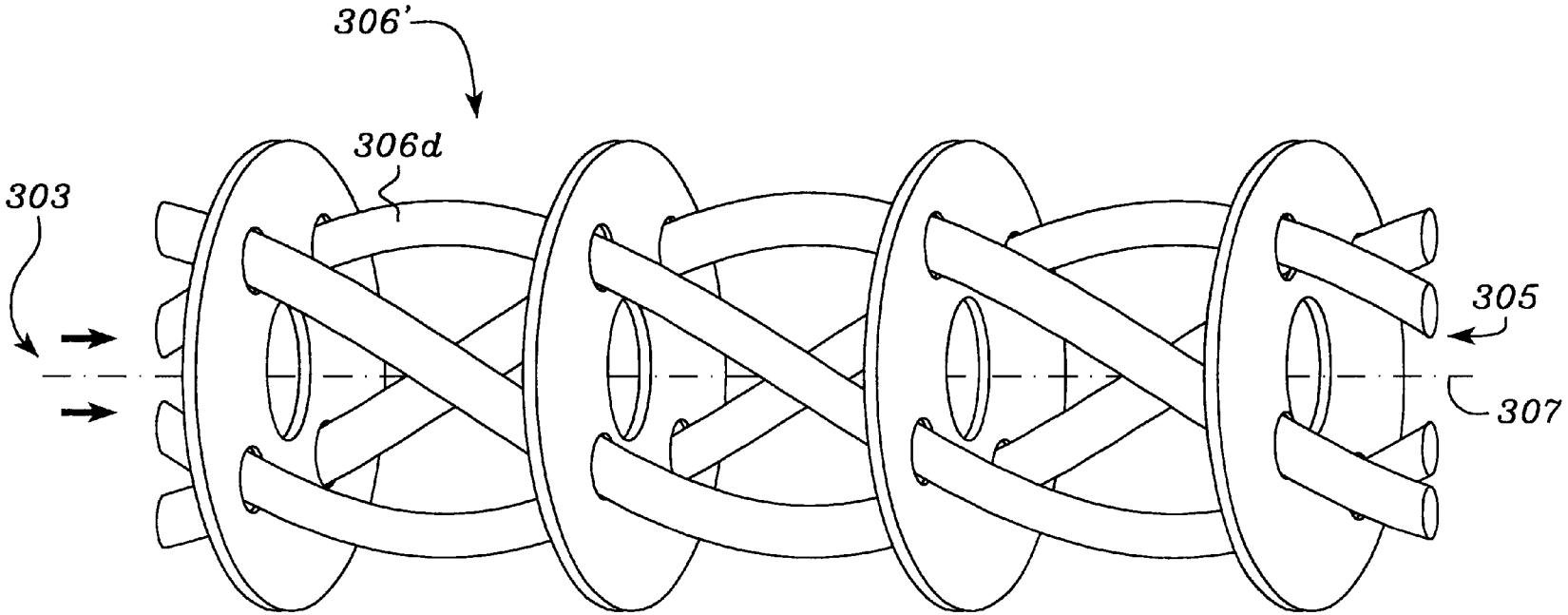

FIGS. 5C–5G illustrate side views of the plurality of rods 306' having a parallel portion and a nonparallel portion to the central axis 307. Where the rods 306' are parallel to the central axis 307, the inscribed radius $r_0$ is constant. Where the rods 306' are not parallel to the central axis 307, the inscribed radius $r_0$ is variable. FIGS. 5C and 5D illustrate nonparallel, splayed rod embodiments having rods 306*a*, 306*a*' alternately splayed from the input end 303 to the output end 305, respectively, and having a variable inscribed radius $r_0$. FIG. 5E illustrates an embodiment comprising both a parallel portion and a nonparallel portion of the rods 306', as curved rods 306*b*. FIG. 5F illustrates both a parallel portion and a nonparallel portion of the rods 306', as bent rods 306*c*. FIG. 5G illustrates one possible embodiment with twisted rods 306*d*. The non-parallel relationships such as are illustrated in FIGS. 5C–5G are all within the scope of the invention. Although not illustrated, other nonparallel embodiments that are also within the scope of the invention include rods 306' alternatingly splayed both ways (rods 306*a*, 306*a*') from the input end to the output end in a single embodiment; or similarly, alternatingly curved (rods 306*b*) or alternatingly bent (rods 306*c*) rods 306' from the input end 303 to the output end 305 in a single embodiment. Moreover, U.S. Pat. No. 5,847,386 to Thomson et al. discusses alternative rod configurations that are within the scope of the present invention. U.S. Pat. No. 5,847,386 is incorporated herein by reference in its entirety. In each of the above embodiments, the central axis 307 is linear from the input end 303 to the output end 305.

Figure 5H:
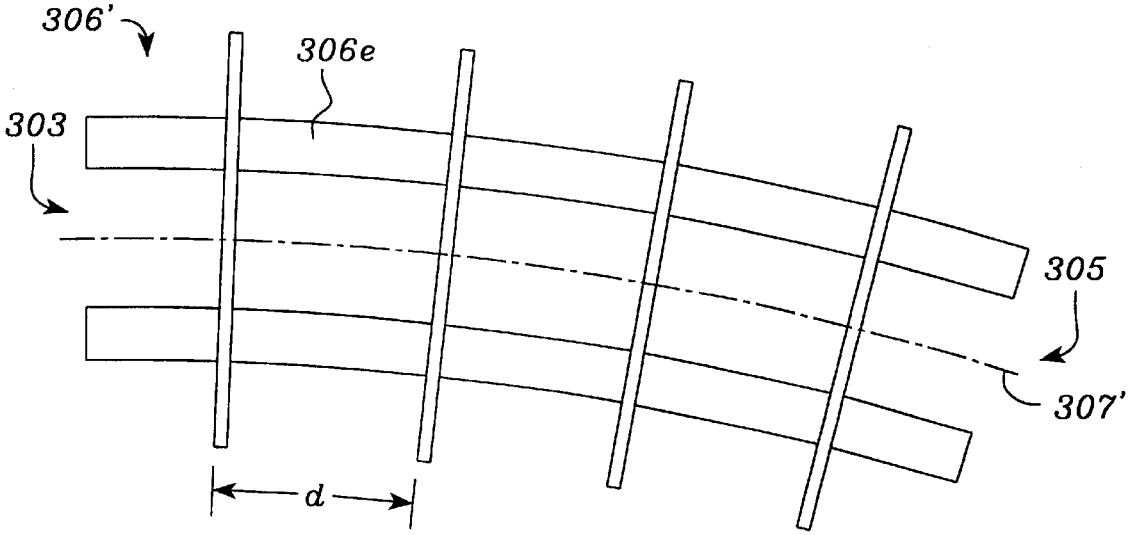
FIGS. 5H–5I illustrate side views of a curved and a bent path embodiments of the present invention.
Figure 5I:
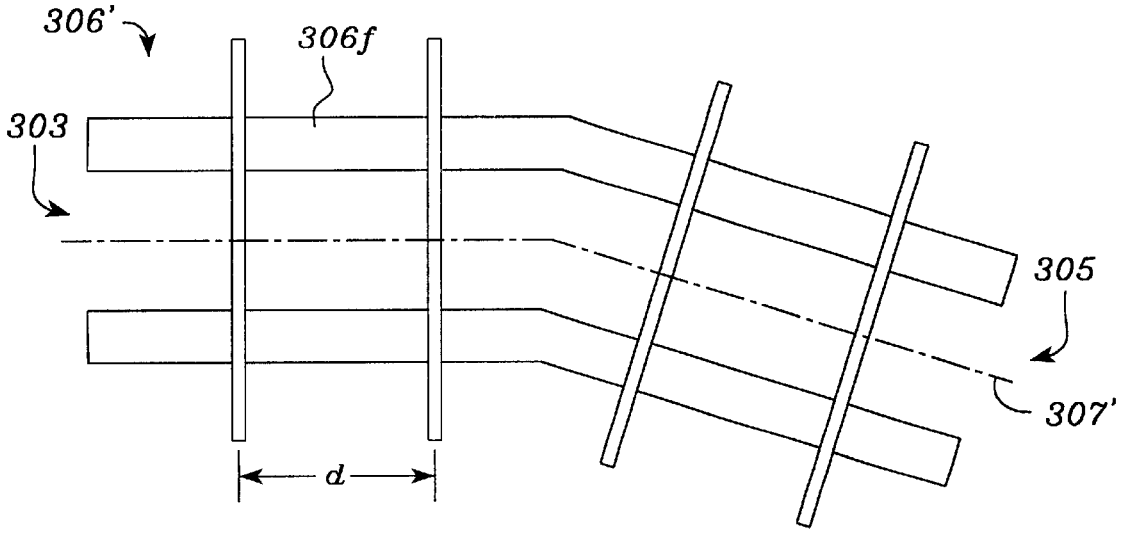

FIGS. 5H and 5I illustrate yet other embodiments where the central axis 307' is nonlinear, or has a nonlinear portion, such that it follows a smooth curved line or a bent path, respectively, for example. The inscribed radius $r_0$ remains constant in these embodiments because the rods 306*e*, 306*f* follow the path of the nonlinear central axis 307'. The rods 306*e*, 306*f* act as in the above-described embodiments to confine the ion beam to a region near the nonlinear central axis 307'. However, unlike the above-described embodiments in FIGS. 5C–5G, the embodiments of FIGS. 5H and 5I impart a lateral force on the ions in the beam, thereby inducing a change in the beam direction.

Such configurations as illustrated in FIGS. 5H and 5I, for instance, might be used to facilitate a more compact packaging arrangement for a plurality of ion guides, placed end-to-end sequentially. When a sequence of ion guides are stacked end-to-end in a linear arrangement, packaging of the plurality of ion guides becomes cumbersome. The nonlinear embodiments illustrated in FIGS. 5H and 5I could be used to "fold" the sequence of ion guides 300 into a more compact shape. One skilled in the art would readily recognize that a variety of nonlinear central axis 307' configurations are possible and a number of possible uses for such configurations. One such use is the separation of neutral or highly energetic ions from the main ion beam, a highly desirable goal in the art. All such ion guides 300 comprising a nonlinear central axis 307' are within the scope of the present invention.

The rods 306, 306' may be cylindrical or other shape and made of a conductive material. Alternatively, the rods 306, 306' may be made from a non-conductive material with a conductive coating. Suitable conductive materials for the rods 306, 306' include, but are not limited to, stainless steel, nickel, or aluminum. A suitable non-conductive material for the rods 306, 306' is alumina, for example. Rods 306, 306' of a non-conductive material must be coated with a conductive coating. Examples of suitable coatings include, but are not limited to, nickel, chromium, molybdenum, or gold or combinations of these coatings. The coatings may be applied to the non-conductive rods 306, 306' by any one of a number of standard coating techniques well known in the art including evaporative deposition and sputtering.

Generally, the materials and conductive coatings suitable for the rods 306, 306' are those that are conductive and non-reactive with respect to the ions, and that are compatible with the pressure environment in which the rods 306, 306' of the ring pole guide 300 of the present invention are used. It should be readily apparent to one skilled in the art that additional materials and coatings exist beyond those enumerated hereinabove that may be suitable for use in the ring pole guide 300 of the present invention. All such materials known in the art are within the scope of the present invention.

Rods 306, 306' can have a variety of cross-section shapes. Preferably, the rods 306, 306' have a cross-section shape that is nominally circular (round) or hyperbolic, due to the relative ease of manufacture. Other rod shapes including, but not limited to, oval, semi-circular, concave, flat or ribbon-like, square, rectangular and other multisided shapes (e.g., hexagonal) may be used, and in some instances, may have advantages over a circular or hyperbolic cross-section. FIGS. 8A–8F illustrate several of these rod shapes including round (FIG. 8A), hyperbolic (FIG. 8B), hexagonal (FIG.

8C), concave (FIG. 8D), flat (FIG. 8E) and square (FIG. 8F) by way of example. One skilled in the art can identify other rod 306, 306' cross-section shapes that may be suitable. All such rod 306, 306' cross-section shapes are within the scope of the present invention.

The radius of the round rod 306, 306' is a function of the ring pole design and includes consideration of the number of rods 306, 306', the ring 308 spacing and the expected energy distribution of the analyte ions. However, for typical designs, the radius of the rod 306, 306', $r_r$, is approximately between 0.5 mm and 8 mm and preferably is about 1.75 mm.

Referring to FIG. 4, the ring stack portion 304 comprises a plurality of rings 308 in a spaced apart stacked relationship distributed along the central axis 307. Each ring 308 of the ring stack portion 304 comprises a thin, conductive plate with a generally centrally located inner through-hole 309. As used herein the term "centrally located" means "at or near a center". Therefore, reference to a centrally located inner through-hole includes those locations that are either centered on the central axis 307, 307' or centered near the central axis, such that the locations allow the central axis 307, 307' to pass through the inner through hole 309.

Alternatively, the rings 308 comprise thin, non-conductive plates with a conductive coating. The inner through-hole 309 of each ring 308 has an inner radius $r_i$, as illustrated in FIG. 5B.

The inner radius $r_i$ is determined partly from considerations of mechanical clearance and partly based on the electromagnetic considerations. Sufficient mechanical clearance must be provided so that the ions traveling through the ring pole ion guide 300 from the input end 303 to the output end 305 have a low probability of impacting the rings 308. In other words, the inner radius $r_i$ should be larger than the nominal radius of the ion beam within the ion guide 300. Therefore, considerations of mechanical clearance favor a larger inner radius $r_i$. On the other hand, the axially oriented electric field produced by the rings 308 during operation of the ring pole guide 300 of the present invention must penetrate into the center of the ring stack portion 304 with sufficient strength to produce the desired axial acceleration of the ions. Considerations of axial electric field intensity tend to favor a smaller inner radius $r_i$. In practice, the inner radius $r_i$ is preferably approximately between 0.2 mm and 5 mm and more preferably about 1.5 mm. Moreover, the thickness of the plate or ring 308 is typically determined from mechanical support considerations. In practice, each ring plate 308 has a thickness that is preferably between 0.125 mm and 1.5 mm, and more preferably about 0.5 mm. However, dimensions outside these preferred ranges for the inner radius $r_i$ and plate thickness are also within the scope of the invention.

The inner through-hole 309 through the rings 308 is nominally circular. The circular shape is chosen in many applications for ease of manufacture and for the circularly symmetric field that is produced when using such a shape. However, other hole shapes such as square and octagonal can be used as well. In addition, complex shapes such as "clover shaped" may also be advantageous for some applications. One skilled in the art can readily determine additionally shapes for the inner through-hole 309. All such shapes are considered to be within the scope of the present invention.

The rings 308 may be fabricated from suitable conductive materials including, but are not limited to, stainless steel or aluminum. Alternatively, non-conductive materials coated with a conductive material may be used. Suitable non-conductive materials are polyamide, glass, or alumina. Suitable conductive coatings include, but are not limited to, nickel, chromium, molybdenum, and gold. As with the rods 306, 306' suitable ring 308 materials are those that are conductive and non-reactive with respect to the ions and that are compatible with the pressure environment in which the ring pole guide 300 of the present invention is used.

The rings 308 are positioned in the spaced apart stacked relationship in the ring pole ion guide 300 such that the central axis 307, 307' passes through the inner through-hole 309, preferably at or near the center thereof. The inner through-hole 309 allows analyte ions or ion beam to pass through the rings 308 as the analyte ions are transported from the input end 303 to the output end 305 of the ring pole ion guide 300 of the present invention.

Moreover, each ring 308 has a plurality of spaced apart through-holes 310, each through hole 310 being dimensioned, positioned and aligned to receive one of the plurality of rods 306, 306' of the multipole portion 302. The through-holes 310 are located around the ring 308 with an angular center-to-center separation θ. Further, a perimeter or outer boundary of each angularly spaced through-hole 310 is a radial distance from central axis 307, 307'. Preferably, the angular separation θ of each through hole 310 is about equal and the radial distance from the central axis is about equal. Additionally, the through-holes 310 have a diameter sufficiently large such that the rods 306, 306' pass through the through-holes 310 without contacting the rings 308. The radial separation between through-holes 310 and the central axis 307, 307' is thus approximately less than or equal to the inscribed radius $r_0$. Accordingly, the rods 306, 306' are electrically isolated from and extend through the rings 308 in the ring pole ion guide 300 of the present invention. As such, the rings 308 are stacked along the length of the poles 306, 306'. Further, each ring 308 comprises an electrode contact.

In FIG. 4, four poles 306 and four rings 308 are illustrated for simplicity. The number of rings 308 is normally determined based on the overall length of the ring pole ion guide 300, as will be detailed below. Preferably, the ring stack portion 304 comprises between four and twenty-four rings 308. The multipole portion 302 of the ring pole 300 can comprise from four to thirty-two rods 306, 306'. Preferably, the multiple pole portion 302 comprises between four and twelve rods 306, 306'.

For simplicity, the term "multipole", as used herein, refers to an assemblage of two or more rods 306, 306'. Therefore, multipoles of the present invention can have either an even number or quantity (2N) or an odd number or quantity (2N+1) of rods 306, where $N \geqq 1$. The present usage of the term "multipole" herein is in contrast to, or expands that found in the literature, where the term "multipole" is generally reserved for assemblages of even quantities of rods. U.S. Pat. No. 5,708,268 issued to Franzen, incorporated herein by reference, describes ion guides with odd numbers of rods and the voltages that are applied thereto. For the five-rod multipole ("pentapole") embodiment of Franzen, the RF voltage source provides a five-phase RF voltage, wherein the voltages of consecutive phases are not applied to adjacent rods. For the invention, the RF voltage source 602 provides an RF voltage having an odd number of phases to the rods in accordance with that disclosed by Franzen.

Referring back to FIGS. 5A and 5B, the rings 308 of the ring stack portion 304 are spaced apart by a distance d equal to about the inscribed radius $r_0$, described above. The ring spacing d can range preferably from 1 mm to 8 mm, and more preferably is about 3.25 mm. For the invention, it is typical for the ring spacing d to be approximately equal to two times the inner radius of the ring $r_i$.

Thus, when the spacing d is less than or equal to the inscribed radius $r_0$, the number of rings 308 for a given ring pole ion guide 300 can be determined by dividing the overall length of the ring pole ion guide 300 by d and rounding up to the next largest integer.

Alternatively, it is within the scope of the present invention for the spacing d between adjacent rings to differ. The primary consideration is that the spacing between adjacent rings should not be too large. If the spacing is too large, the probability of ions loosing too much velocity increases to unacceptable levels and ion trapping can occur.

FIG. 6A illustrates the electrical interconnections for the ring pole ion guide 300 of the present invention, having four rods, for example. The rods 306 of the multipole portion 302 are connected to the RF voltage source 602. The RF voltage source 602 is equivalent to and is applied in a manner that is consistent with the conventional multipole, both for odd and even quantities of rods, as known in the art. Thus, for the quadrupole example illustrated in FIG. 6A, the rods 306 are divided up into a first rod pair 604 and a second rod pair 606. Each rod pair 604, 606 consists of two rods 306 located on opposite sides of the central axis 307 at an angular separation θ of one hundred eighty degrees. A first RF voltage VR1 is applied to the first rod pair 604 and a second RF voltage VR2 is applied to the second rod pair 606. The second RF voltage VR2 is preferably of about the same magnitude as, and one hundred eighty degrees out of phase with, the first RF voltage VR1. However, the magnitude of the voltages may be the same or different from the RF voltage source 602. One skilled in the art could readily determine an appropriate set of RF voltages for other multipole arrangements known in the art, including those with both even and odd quantities of rods 306, 306'. All such sets of RF voltages are within the scope of the invention.

Typically, the RF source 602 used with the ring pole guide 300 of the present invention produces an RF voltage with a frequency preferably between one and ten megahertz. While the exact RF frequency used is a function of the overall design and application of the ring pole guide 300, the general guidelines for selecting the frequency are similar to those for conventional multipoles known in the art. However, it has been observed that in the case of the ring pole guide 300, the optimal frequency is approximately twice that of the equivalent, conventional multipole guide. Similarly, the magnitudes of the RF voltages are preferably approximately the same as would be used for a conventional multipole. Voltages in the range of one hundred volts to one thousand volts are often used. For example, a suitable combination of voltage magnitude and frequency might be six hundred volts at five megahertz for a hexapole configuration.

Figure 6B:
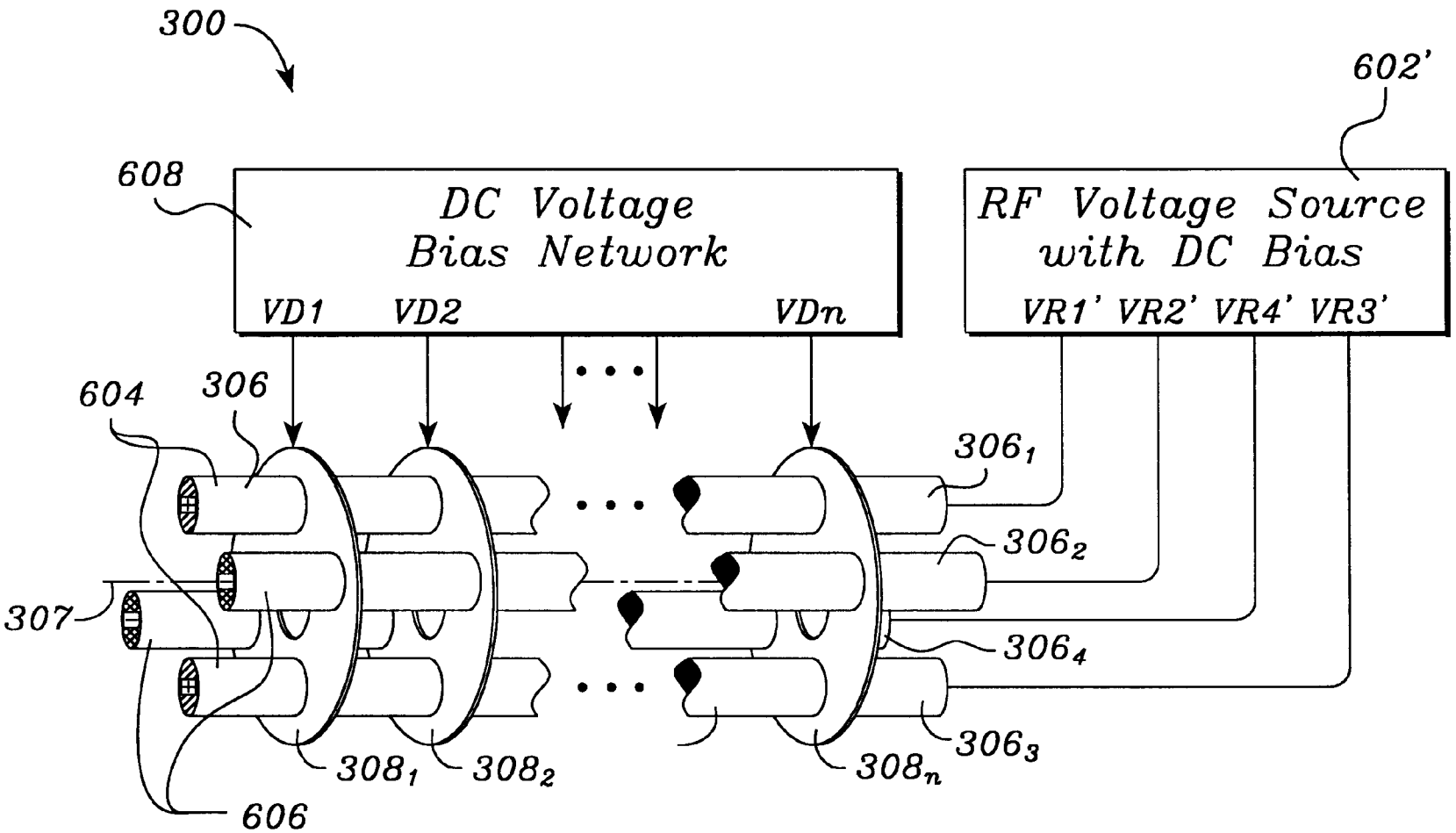
FIG. 6B illustrates a schematic view of another embodiment of the interconnection of the RF voltage source and the DC voltage bias network to the ring pole ion guide of the present invention wherein the RF voltage source comprises a DC bias for supplying a DC offset voltage.
Figure 6C:
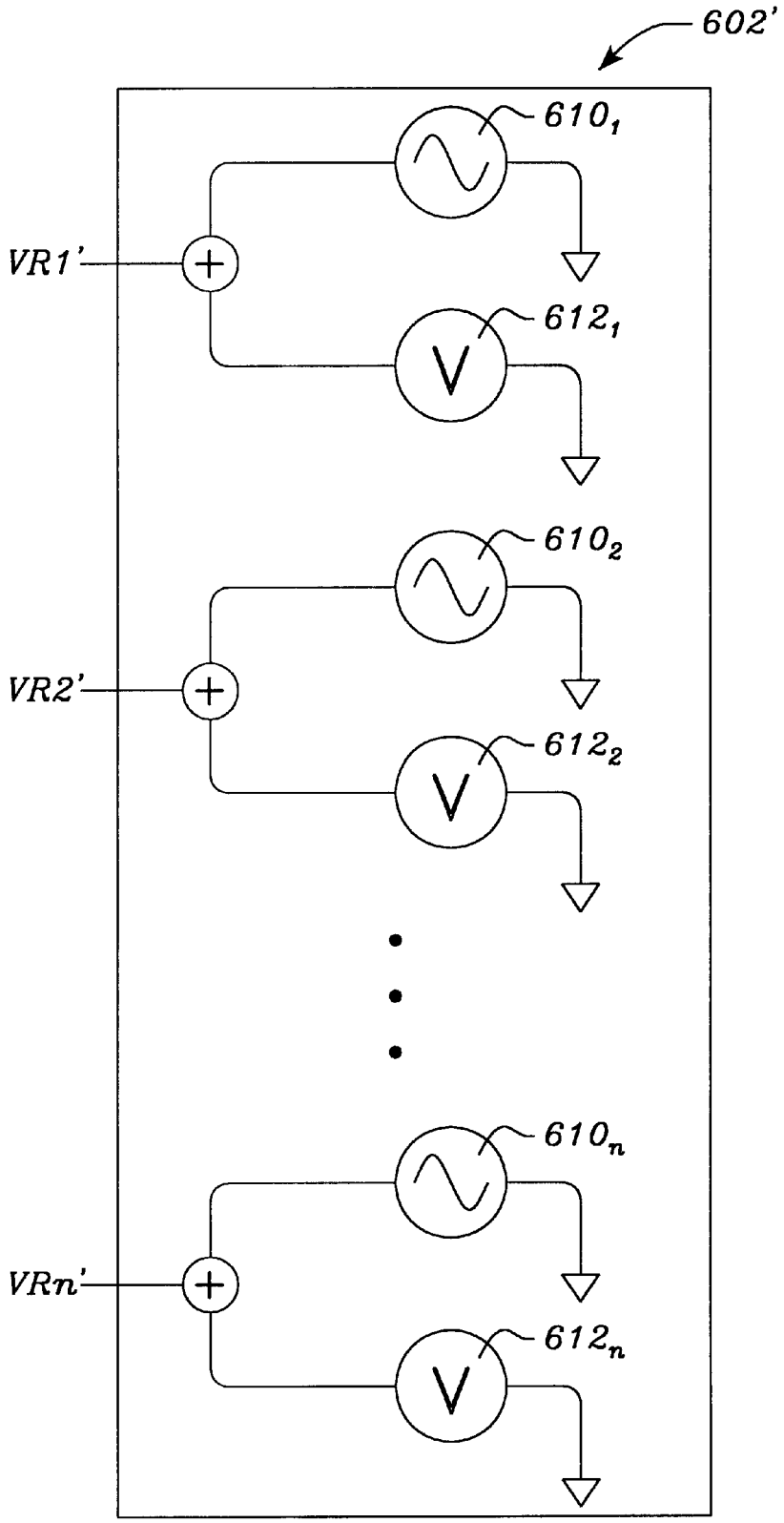
FIG. 6C illustrates a schematic view of one embodiment of the RF voltage source with DC bias of FIG. 6B.

In another embodiment, illustrated in FIG. 6B, an RF voltage source with DC bias 602' is used to drive all of the rods 306. In this embodiment, RF voltages are supplied to all of the rods 306 of the multipole portion 302 that have magnitudes and phases that can be independent from one and other. In addition, independently selected DC bias or offset voltages can be added to the RF voltages supplied to all of the rods 306 to produce advantageous results. FIG. 6C illustrates a schematic representation of one possible implementation of the RF voltage source with DC bias ("RF/DC voltage source") 602'. As illustrated therein, the RF/DC voltage source 602' comprises a set of RF sources $\mathbf{610}_1$, $\mathbf{610}_2$, . . . , $\mathbf{610}_n$ for supplying the RF voltages to all of the rods. The RF/DC voltage source 602' further comprises a set of DC sources $\mathbf{612}_1$, $\mathbf{612}_2$, . . . , $\mathbf{612}_n$, for supplying the DC bias voltages to all of the rods. The RF and DC voltages for each rod are independently summed together to produce rod driving voltages VR1', VR2', . . . , VRn' to each respective rod. The rod driving voltages VRn' are connected to the correspondingly numbered rods $\mathbf{306}_1$, $\mathbf{306}_2$, . . . , $\mathbf{306}._n$, as illustrated in FIG. 6B for the case of n=4 for simplicity. The sum of the RF and DC voltages supplied to each rod advantageously can be used to control the shape of the potential well formed by the RF fields.

The schematic implementation of the RF/DC voltage source 602' illustrated in FIG. 6C is but one way to implement the RF/DC voltage source 602' of the invention. A variety of implementations would be readily apparent to one skilled in the art, all of which are within the scope of the present invention. For example, one embodiment of RF/DC voltage source 602' could be the RF voltage source 602, when the DC bias source thereof is set to zero volts. In another example, the RF/DC voltage source 602' can produce a set of rod driving voltages VRn' wherein the RF voltage applied to each rod 306 has a different or the same magnitude and there is a 180 degrees phase difference between the RF voltages applied to adjacent rods 306. Therefore, by choosing the magnitude and phase of the RF sources $\mathbf{610}_n$ and the voltages of the DC offset voltage sources $\mathbf{612}_n$, an arbitrary set of rod driving voltages VRn can be produced by the RF/DC voltage source 602'. It should be clear, therefore, that the RF/DC voltage source 602' represents a general implementation for driving the rods 306 for which there are many useful examples.

Figure 7A:
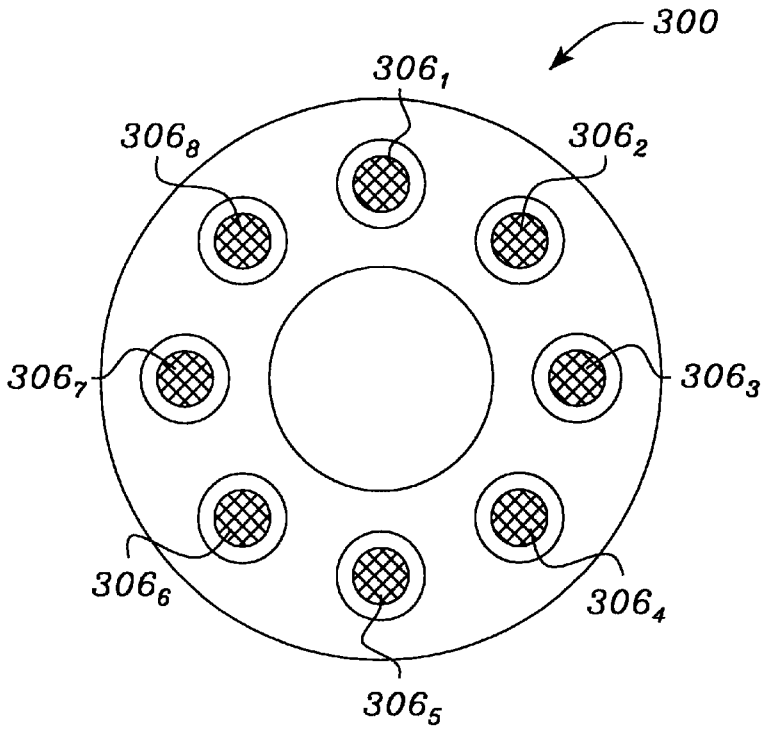
FIG. 7A illustrates an end view of an octapole multipole of the invention wherein the rods are numbered clockwise by way of example.

FIG. 7A illustrates an end view of an ion guide 300 of the present invention in which the individual rods 306 of the multipole portion 302 are numbered from $\mathbf{306}_1$ to $\mathbf{306}_8$ clockwise for simplicity. Therefore, the octapole example illustrated in FIG. 7A comprises a set of even numbered rods 306 ($\mathbf{306}_2$, $\mathbf{306}_4$, $\mathbf{306}_6$, and $\mathbf{306}_8$) and a set of odd numbered rods ($\mathbf{306}_1$, $\mathbf{306}_3$, $\mathbf{306}_5$, and $\mathbf{306}_7$).

Figure 7B:
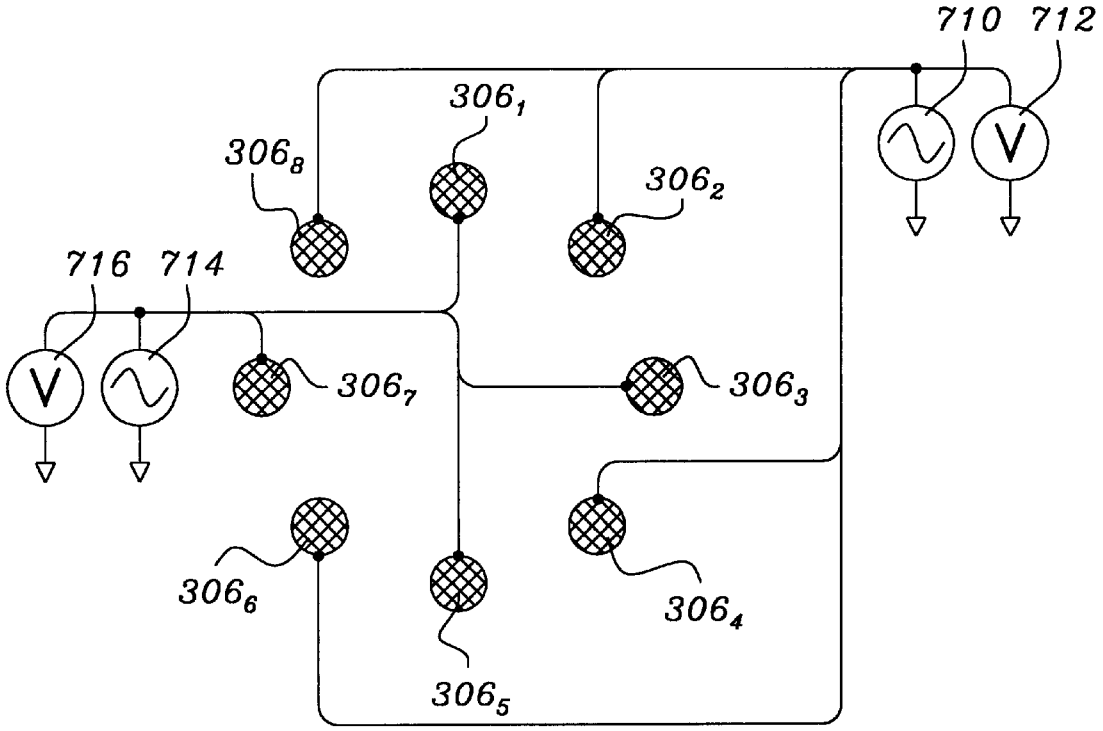
FIGS. 7B–7D illustrate several alternate embodiments for driving the rods of the octapole of FIG. 7A with the RF voltage source with DC bias.

FIG. 7B illustrates the octapole of FIG. 7A interconnected to the RF/DC voltage source 602' in one embodiment to drive the rods 306. In the example illustrated in FIG. 7B, the set of even number rods $\mathbf{306}_2$, $\mathbf{306}_4$, $\mathbf{306}_6$, and $\mathbf{306}_8$ is driven by an RF voltage having a first magnitude supplied by an RF source 710 and a DC voltage having a first value supplied by a DC source 712. A second RF voltage having a second magnitude and a second DC voltage having a second value are supplied by a second RF source 714 and a second DC source 716, respectively, and supplied to the set of odd number rods $\mathbf{306}_1$, $\mathbf{306}_3$, $\mathbf{306}_5$, and $\mathbf{306}_7$. In this configuration, the first and second values of the DC voltage and/or the first and second magnitudes of the RF voltages to all rods independently may be the same or different, while the phase of the RF voltages from RF source 712 might be 180 degree out of phase with that from RF source 714.

Figure 7C:
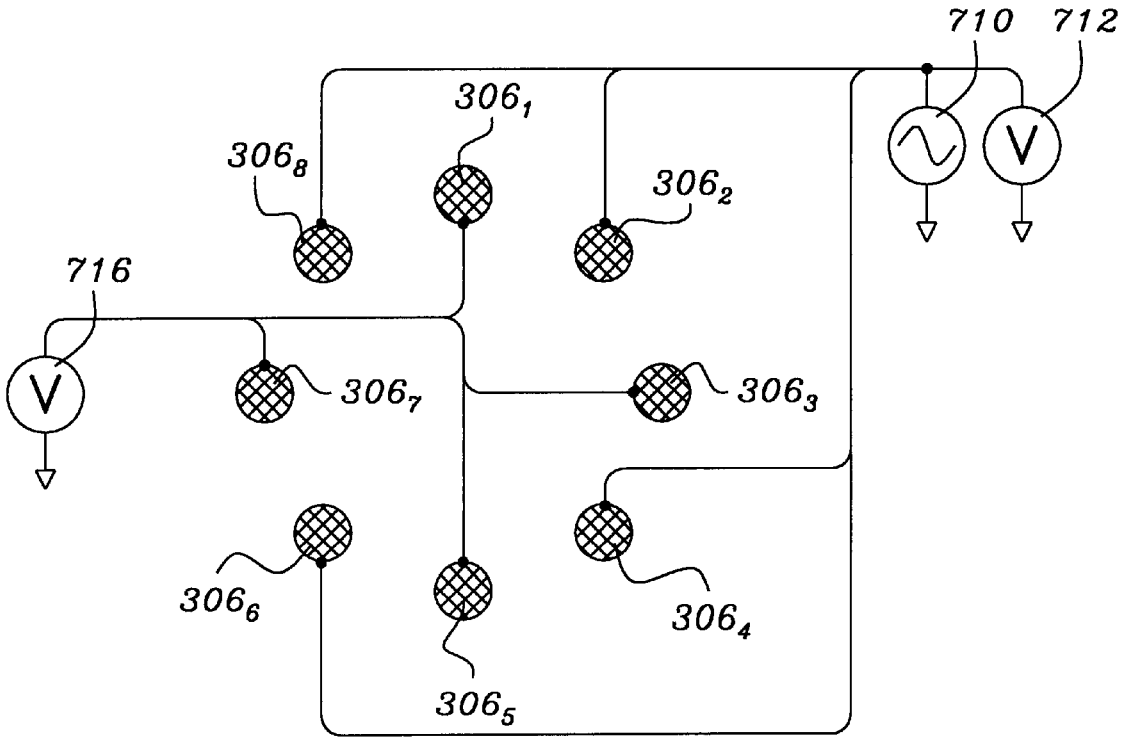

FIG. 7C illustrates the octapole of FIG. 7A interconnected to the RF/DC voltage source 602' in yet another example. In this example, an RF voltage from RF source 712 plus a DC offset voltage from DC source 710 are supplied to all even numbered rods $\mathbf{306}_2$, $\mathbf{306}_4$, $\mathbf{306}_6$, $\mathbf{306}_8$, while only a DC voltage from DC source 714 is supplied to the odd numbered rods $\mathbf{306}_1$, $\mathbf{306}_3$, $\mathbf{306}_5$, $\mathbf{306}_7$. In one embodiment of this example, the DC voltages from DC sources 710, 714 supplied to all rods can have the same value so that the entire set of rods is biased to the same particular DC level, while the even numbered rods have an additional RF voltage supplied thereto. In embodiments where the DC bias voltage is supplied to the rods along with the RF voltage, the RF voltage will oscillate about the DC bias voltage, as is well known in the art.

Figure 7D:
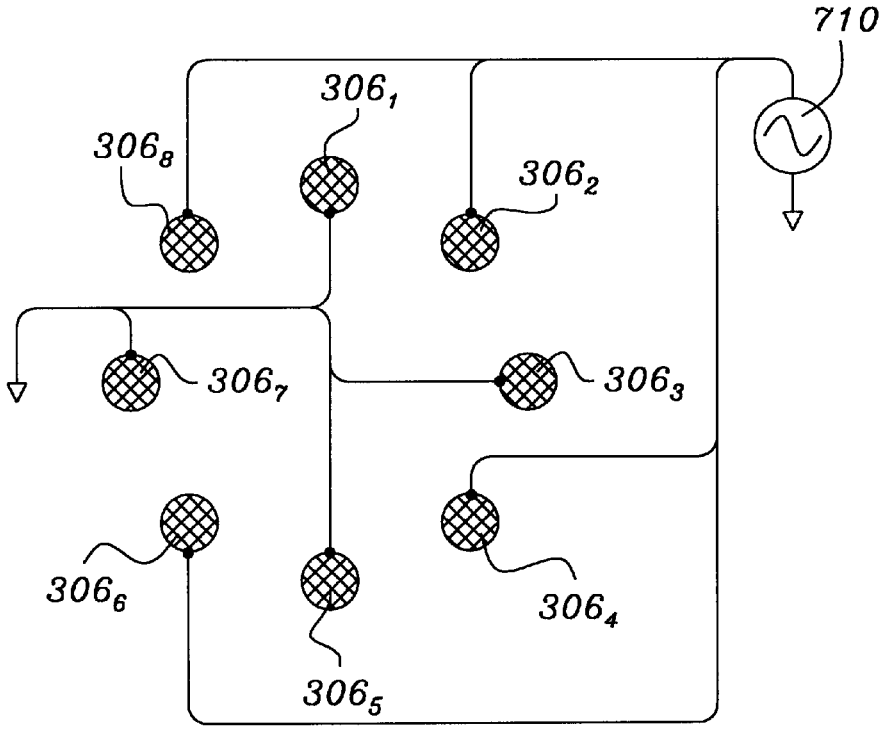
Figure 8A:
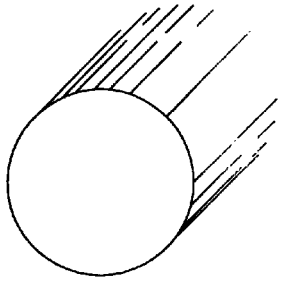
FIGS. 8A–8F illustrate perspective end views of several possible alternative rod cross-section profiles including round, hyperbolic, hexagonal, concave, flat and square profiles.
Figure 8B:
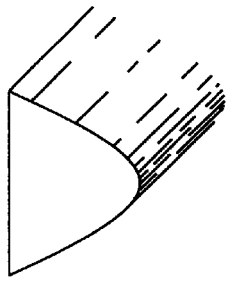
Figure 8C:
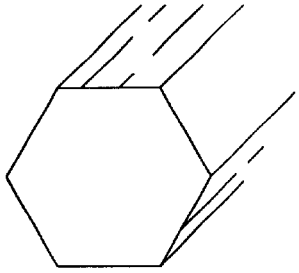
Figure 8D:
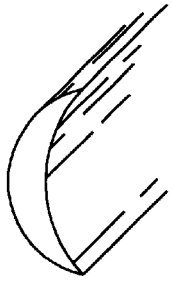
Figure 8E:
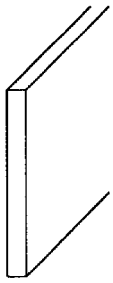
Figure 8F:
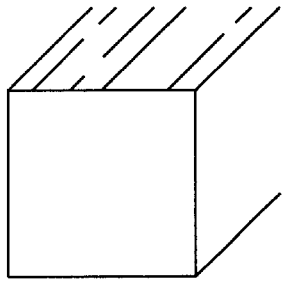

FIG. 7D illustrates yet another example of the interconnection of the RF/DC voltage source 602' to the octapole of FIG. 7A. In this example, an RF voltage source 710 supplies an RF voltage to the even numbered rods. However, the odd numbered rods are connected to a ground potential. Advantageously, the RF/DC voltage source 602' has flexibility, such that this example can be implemented by the example illustrated in FIG. 7C also, by setting the two DC voltage sources 712, 714 to zero volts.

The rings 308 of the ring stack portion 304 are connected to the DC voltage bias network 608. The DC voltage bias network 608 produces a set of DC voltages VD1–VDn, where n is equal to the number of rings 308. Thus, if there were four rings for example, the DC voltage bias network 608 would produce four voltages {VD1, VD2, VD3, VD4}. Each of the voltages VD1–VDn, in turn, is applied to one of the n rings 308. The voltages VD1–VDn are applied in numerical order to the rings 308 such that VD1 is applied to a first ring $\mathbf{308}_1$ located closest to the input end 303 of the ring pole ion guide 300 and VDn is applied to a last ring $\mathbf{308}_n$ located closest to the output end 305 of the ring pole ion guide 300. Voltage VD2 is applied to a second ring $\mathbf{308}_2$ adjacent to the first ring $\mathbf{308}_1$, and so on, until all voltages VD1–VDn have been applied to all rings 308 between the first ring $\mathbf{308}_1$ and the last ring $\mathbf{308}_n$. Preferably, the voltages VD1–VDn produced by the DC voltage bias network 608 are determined such that VD1>VD2> . . . >VDn for positive ions. For negative ions, the voltages are applied such that VD1<VD2< . . . <VDn. These relationships between voltages produce an axial field that tends to move the ions from the input 303 to the output 305 of the ion guide 300.

In addition to the desire for producing an axial field oriented from input 303 to output 305 the field condition as a function of distance traveled through the guide 300 can be controlled. Three principal axial field conditions are defined as constant field, increasing field and decreasing field. These three field conditions, in turn, lead to three relationships between the voltages VD1–VDn. For a constant field, the voltages VD1–VDn are selected such that the voltage difference ΔV between any two voltages applied to adjacent rings is constant throughout the ring stack portion 304. For a constant field case, the change in voltage ΔV is determined by equation (1) below.

$$VDi-VDi-1=\Delta V, \text{ for } i=2 \ldots n \tag{1}$$

An increasing field is one in which the axial field magnitude increases as a function of distance from the input end 303 of the ring stack portion 304. This type of field condition can be produced by increasing the voltage difference between the voltages VDi applied to adjacent rings 308*i* as a function of distance from the input 303. Likewise, the decreasing field condition can be produced by decreasing the voltage difference between the voltages VDi applied to adjacent rings 308i as a function of distance from the input 303.

The choice of whether to use an increasing, decreasing or constant field is often made based on the pressure under which the guide 300 is to be operated. Typically, for high pressure operation and in some applications such as in collision cells, an increasing field is desirable. For low pressure applications, a constant field is often found to be optimal. A decreasing field is sometimes used in cases where the pressure is decreasing such as when one of the rings 308 of the guide 300 forms a vacuum partition 308' separating chambers of different pressure.

While the DC voltages VD1–VDn can be chosen by a variety of means, one rule of thumb for their selection is exemplified in equation (2) below.

$$E(z)=Az^m+B \tag{2}$$

In equation (2), E(z) is the electric field strength along the central axis 307 of the ring pole device 300 oriented parallel to the z-axis of a Cartesian coordinate system and B is an electric field strength that is independent of z and may be zero. The coefficient A is a scalar quantity used to adjust the overall magnitude of the field and the term m is typically chosen to be between minus three and plus three. Choosing m=2 for example, results in the field strength doubling for every unit length in the z-direction, thereby producing an increasing field condition. The actual values of VD1–VDn are readily determined from the field strength E(z) of equation (2) and the dimensions of the rings by applying Maxwell's Equations as is well known in the art. For example, in the case of four rings, the DC voltages might range from 0 volts for VD1 to −33 volts for VD4. While using equation (2) is an example of one way to determine the electric field, other ways to determine the electric field do exist and are readily determinable by one skilled in the art, without undue experimentation. The scope of the invention is intended to include all such ways of determining the electric field.

In yet other embodiments, it is advantageous to apply a retarding potential to the ring closest to the input end 303 of the ring stack portion 304. A retarding potential is one that produces an electric field that opposes or retards the motion of the ions. For instance, such a field can be used to slow down ions entering the ring pole guide 300 with too much axial energy. For example, in the case of using such a retarding potential with positively charged 20 eV ions, the DC voltages VD1–VD5 might be chosen equal to {10, 5, −5, −15, −33}. The DC voltage of VD1=10 volts produces an electric field that initially slows the positively charged ions entering the ring pole guide 300. Once the ions have passed the first ring $\mathbf{308}_1$, the ions are accelerated toward the output end 305 of the ring pole guide 300 by the electric fields produced by the remaining rings 308 biased by the DC voltages VD2–VD5. A rule of thumb for whether or not to use a retarding potential is that if the ion beam radius entering the ring pole ion guide 300 is less than about one-half the inner radius $r_i$ of the rings 308, a retarding potential is not needed. One skilled in the art would readily be able to choose the DC voltages without undo experimentation.

Importantly, the numbers of voltages needed for the ring pole ion guide 300 of the present invention are reduced relative to the conventional ion guides. The number of RF voltages required does not change relative to the conventional multipole guides and the number of DC voltages is less, because the present invention uses fewer rings 308 than in the conventional ring stack and ion funnel guides. The ion guide apparatus 300 of the present invention has better performance for lower manufacturing and operation costs than the prior art devices.

Several numerical models of the ring pole device 300 having 4 rods 306 (quadrupole) and six rods 306 (hexapole) were constructed. The performance of these models was simulated using ions from about 50 to about 500 AMU at about 0.2 Torr pressure. In the model, the ions were seen to travel through the ring pole ion guide 300 in a well-collimated beam and with little or no loss due to trapping or other effects. The shape of the ion beam is a result of the effects of the RF field, DC electric field gradient, ion energy, and the ion collisions provided by the unique ring pole apparatus 300. The effects of the rings 308 on ion acceleration, as well as the effects of the rods 306 on ion focusing, were both clearly visible. Without the acceleration, the ions were not transported through the device.

Modeling of the quadrupole and hexapole embodiments show excellent results for ions down to about 100 AMU and acceptable behavior at about 50 AMU at pressures of 0.2 Torr. In addition, modeling showed no difficulty in transporting ions at pressures as high as 5 Torr. Moreover, there was good focusing especially with higher masses and pressures.

Through empirical results obtained by modeling, the preferred inscribed radius $r_0$ of the rods 306 of the ring pole guide 300 of the present invention was determined to be somewhat greater than that for the conventional multipole. The inside radius $r_i$ of the rings 308 was determined through modeling to be preferably about 1.75 times the input beam radius to achieve the highest transmission efficiency. In addition, it was found that the rings could extend well into the multipole (i.e., $r_i << r_0$). The ultimate limit of the inner radius $r_i$ is essentially set by the beam diameter and considerations of transmission efficiency. The preferred RF frequency applied to the multipole portion 302 was determined from modeling to be about twice that normally applied to a conventional multipole.

The modeling also showed that retarding voltages described hereinabove may be used on the first ring $\mathbf{308}_1$ to keep ions from impacting this ring $\mathbf{308}_1$ before the rods 306 can begin to focus the ions. The use of retarding voltages is often a function of pressure. The higher the pressure, the better was the focusing and therefore, the lower was the need for retarding voltages. Moreover, the strength of the axial field (principally a function of the voltage drop between electrodes) may be relatively low near the front of the device, but may increase toward the back of the device as described hereinabove.

Figure 9:
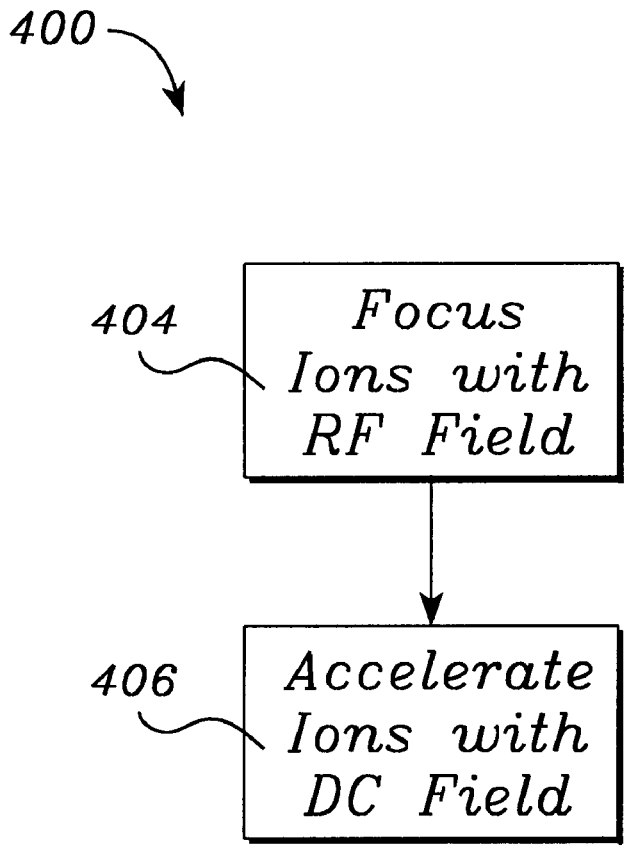
FIG. 9 illustrates a flow chart of the method of transporting ions in accordance with the invention.

A method 400 of transporting ions using the ion guide 300 of the present invention is illustrated in FIG. 9. Ions are introduced into the input end 303 of the ion guide 300. The method 400 comprises the step of focusing 404 the ions using an RF field having a pseudo potential well aligned with a central axis 307 of the ion guide 300. The step of focusing 404 comprises the step of supplying RF voltages and in some embodiments, DC bias or offset voltages to one or more of the rods to create the RF field. The application of the RF voltages and the DC offset voltages are described further above. For example, for an even number of rods 306, the RF voltages may be of a same or a different magnitude, supplied to one or more of the rods, and may be 180 degrees out of phase for adjacent rods 306. Further, a DC offset voltage may be a same or a different value and supplied to one or more of the rods 306. See the discussion above for FIGS. 6A–6C and 7A–7D. The method 400 further comprises the step of accelerating 406 the ions using a DC electric field aligned with the central axis 307 of the ion guide 300. For positive ions, the step of accelerating 406 comprises the step of applying DC voltages VD1–VDn to the rings $\mathbf{308}_{1\rightarrow n}$, where VD1>VD2> . . . >VDn to produce the DC electric field aligned with the central axis 307. (For negative ions, the applied DC voltages are VD1<VD2< . . . <VDn.) The ions are ejected from an output end 305 of the ion guide 300 thereafter.

Figure 10:
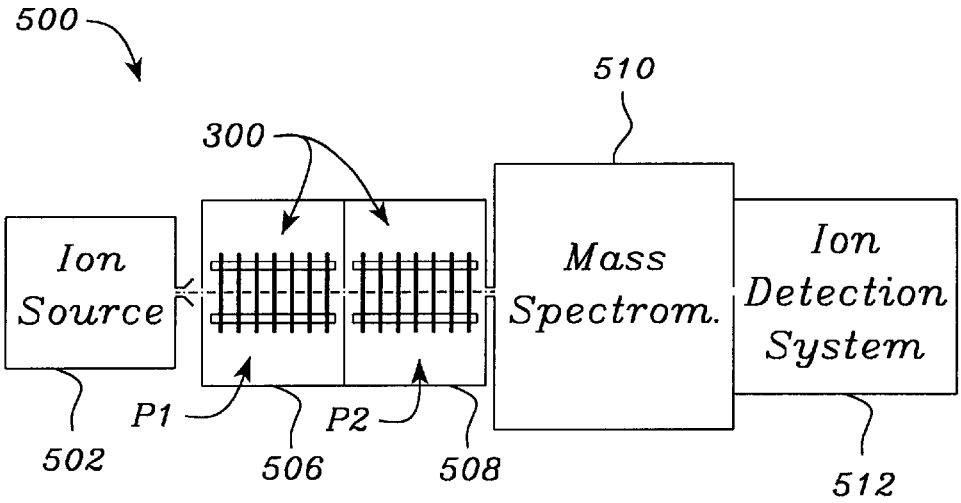
FIG. 10 illustrates a mass spectrometer system including the ring pole ion guide apparatus in accordance with the present invention.

The ring pole ion guide 300 and method 400 of the present invention provide novel ion transport that can be used in mass spectrometry. A mass spectrometer system 500 utilizing the ring pole ion guide 300 of the present invention is illustrated in FIG. 10. The mass spectrometer system 500 comprises an ion source 502, a first pressure transition stage 506, a second pressure transition stage 508, a conventional mass spectrometer 510, and an ion detection system 512. The mass spectrometer 510 can be any type of mass spectrometer including but not limited to a quadrupole mass filter, an ion trap, a time-of-flight instrument, a FTMS or a magnetic sector spectrometer, all of which are well known in the art. The ring pole guide 300 and method 400 are used in each of the pressure transition stages 506, 508 to transport the ions in a well collimated beam from the ion source 502 to the mass spectrometer 510. The pressure transition stages 506, 508 transition the pressure level through which the ions are traveling from that of the ion source 502 to that of the mass spectrometer 510. The intermediate pressures in the pressure transition stages 506, 508 are P1 and P2, respectively. For example, if the ion source 502 is operated at a pressure of 760 Torr, the pressure P1 inside the first pressure transition region 506 is much less that 760 Torr, for example at 0.1 Torr, and the pressure P2 inside the second pressure transition stage 508 is much less than pressure P1, for example P2 might be at 0.001 Torr. Further, the pressure of the mass spectrometer 510 is much less than P2.

Advantageously, the apparatus 300 and method 400 simultaneously achieve both the ion beam focusing and confinement of a conventional multipole and the axial field ion acceleration of a conventional DC ring guide all in one device using fewer rings and DC voltages. In the present invention, the multiple pole portion 302 of the ion guide 300 provides the focusing and confinement by virtue of the psuedo-potential well produced by the applied RF voltages. The ring stack portion 304 of the present invention, in turn, provides the axial electric field required to accelerate analyte ions as they are transported. However, unlike the conventional DC ring guide, the ring stack portion 304 is not used to establish a confining, effective potential-well. Therefore, the ring 308 spacing d of the present apparatus 300 can be greater than that of a conventional ring guide or ion funnel. The ring pole ion guide 300 and the method 400 of the present invention provide transport of ions through the two pressure transition regions 506, 508 of the mass spectrometer system 500 with high transport efficiency. Only two pressure transition regions 506, 508 are illustrated in FIG. 10 for simplicity. One skilled in the art would readily recognize that the mass spectrometer system 500 could have more than two, or a plurality of, pressure transition regions and utilize a plurality of ring pole ion guides 300 of the invention and still be considered as within the scope of the present invention.

Figure 11:
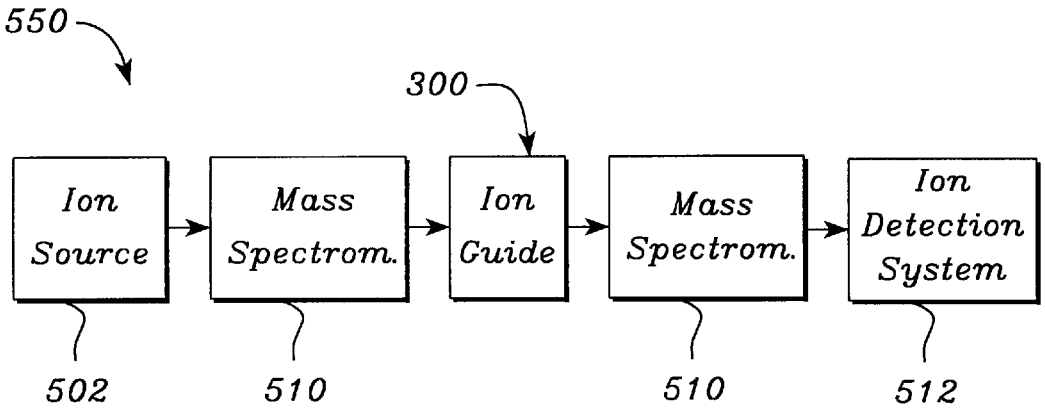
FIG. 11 illustrates a two-stage mass spectrometer system wherein the ring pole ion guide in accordance with the present invention transports ions from one mass spectrometer stage to another.

As is the case for conventional ion guides, the ring pole ion guide 300 and method 400 can be used to transport ions between two adjacent conventional mass spectrometer stages, also known as MS/MS. FIG. 11 illustrates a block diagram of a two-stage mass spectrometer MS/MS 550 according to the present invention having the ion guide 300 between the conventional MS stages 510.

Figure 12:
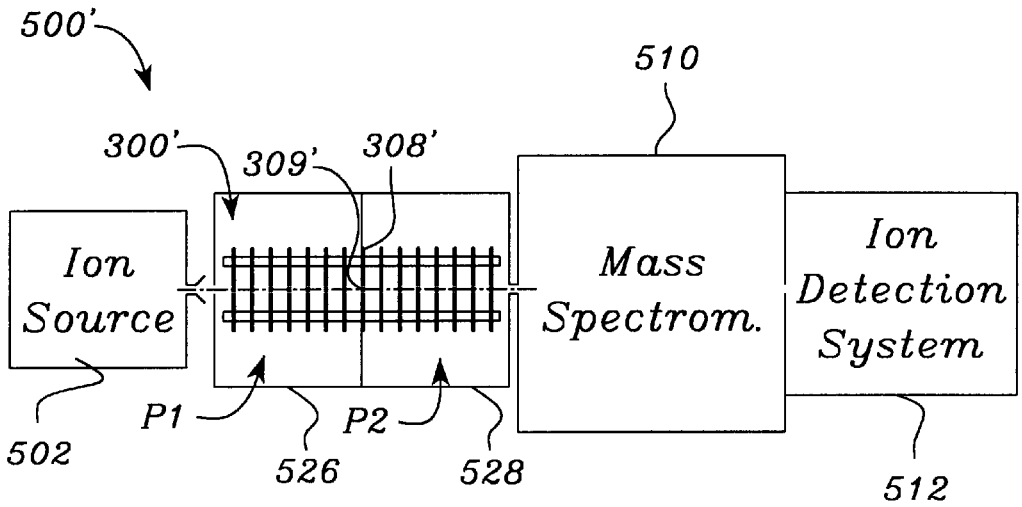
FIG. 12 illustrates a mass spectrometer system including the ring pole ion guide apparatus in accordance with the present invention that spans two pressure transition stages.

Moreover, unlike conventional ion guides, a single ring pole ion guide 300' of the present invention can be used to span a plurality of pressure transition stages, such as the stages 506, 508 of the mass spectrometer system 500 in FIG. 10, to transport ions therethrough. FIG. 12 illustrates a ring pole ion guide 300' of the present invention spanning two pressure transition stages 526 and 528, for example, of a mass spectrometer system 500'. In FIG. 12, one of the rings 308' of the ring pole ion guide 300' acts as a pressure aperture or partition between and separating the two pressure transition stages 526 and 528. The inner through-hole 309' in at least partitioning ring 308' is sized to limit the gas conductance between chambers, such that the pressure transition stages 526, 528 can maintain a desired pressure with vacuum pumps notwithstanding the leakage through the inner through-hole 309' of the ring 308'. When the single ring pole ion guide 300' spans a plurality of pressure stages, a plurality of partitioning rings 308' delineate and function as pressure partitions between stages. The plurality of partitioning rings 308' are separated by the rings 308, as described above for the ion guide 300.

Figure 13:
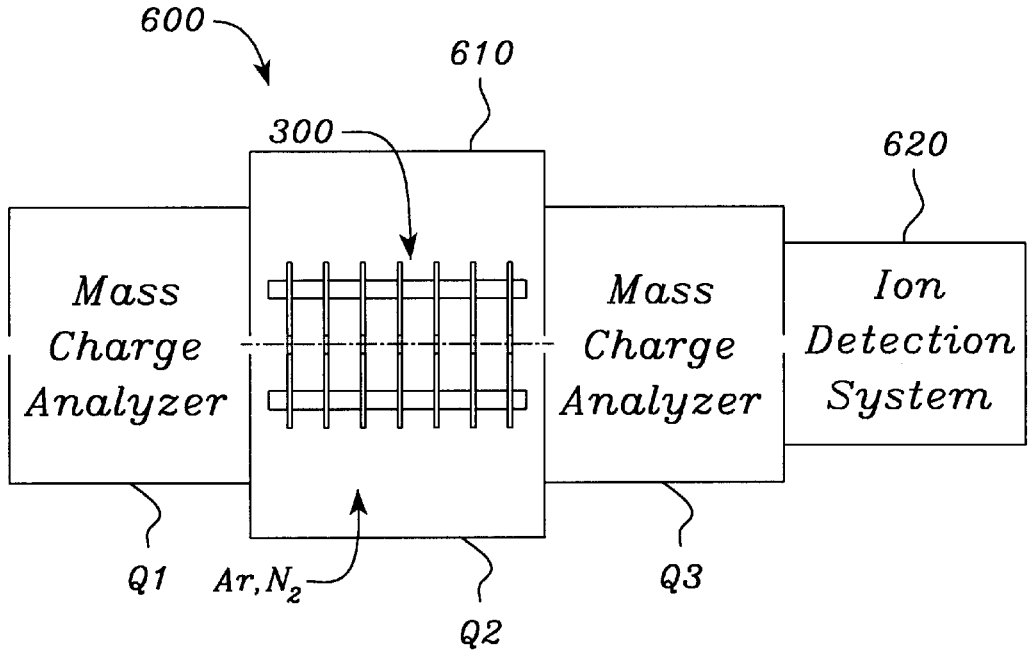
FIG. 13 illustrates a multiple mass/charge analysis system employing an ion dissociation system in accordance with the present invention.

In another aspect of the invention, the ring pole ion guide 300, 300' may be used in place of conventional ion guides in a collision cell or an ion dissociation system used in multiple mass/charge analysis systems known in the art as a "triple quad" or simply, "QQQ" systems. FIG. 13 illustrates a triple quad system 600 of the present invention. The system 600 comprises three stages Q1–Q3 and an ion detection system 620. A first stage Q1 and a third stage Q3 are relatively low pressure stages and function as traditional mass/charge analyzers. A second stage Q2, between stages Q1 and Q3, contains the ion guide 300, 300' according to the present invention. The second stage Q2 is an ion dissociation stage 610. In the second stage Q2, a gas such as Nitrogen ($N_2$) or Argon (Ar) is introduced at moderate pressure of about $10^{-1}$ to $10^{-4}$ Torr. The gas molecules collide with sufficiently energetic analyte ions causing fragmentation and producing daughter ions. The ion transport mechanism used in the QQQ system 600 must be able to both contain the analyte and daughter ions as well as transport them. The ring pole ion guide 300 and ion dissociation system 610 of the present invention advantageously provide simultaneous confinement and transport/acceleration of both the analyte ions and daughter ions more efficiently and effectively than conventional ion guides and QQQ systems. Q1 and Q3 can each be any mass/charge analyzer, including but not limited to a quadrupole mass filter, an ion trap, a time-of-flight instrument or a magnetic sector spectrometer. Although not illustrated, the multiple mass/charge analysis system 600 of the present invention may have more than three stages and the ion dissociation system 610 may comprise more than one stage of the system 600 and still be within the scope of the present invention.

Thus there have been described a novel ring pole ion guide 300, 300' and method 400 for ion transport that advantageously and unexpectedly provides simultaneous ion acceleration and confinement in an efficient manner. Additionally, mass spectrometer systems 500, 510, 550, 600 and an ion dissociation system 610 utilizing the ring pole ion guide 300, 300' have been described. The ring pole ion guide 300, 300', method 400 and systems 500, 510, 550, 600, 610 provide significant advantages over conventional ion guides and mass spectrometry and ion dissociation systems known in the art. It should be understood that the above-described embodiments are merely illustrative of the some of the many specific embodiments that represent the principles of the present invention. Clearly, those skilled in the art can readily devise numerous other arrangements without departing from the scope of the present invention.

What is claimed is:

1. An apparatus for guiding ions having an input end for accepting ions and an output end for ejecting ions and having a central axis extending from the input end to the output end comprising:

a multipole portion; and a ring stack portion extending inside the multipole portion, wherein the ring stack portion produces a direct current (DC) electric field oriented along the central axis for accelerating ions from the input end to the output end and wherein the multipole portion produces a radio frequency (RF) field that confines the ions to a region around the central axis.

2. The apparatus of claim 1, wherein the multipole portion comprises a plurality of spaced apart rods oriented relative to the central axis, and wherein the ring stack portion comprises a plurality of spaced apart rings in a stacked relationship along the central axis, each ring having an inner through-hole aligned with the central axis, and a plurality of angularly spaced apart through-holes, each angularly spaced through-hole for receiving a different one of the plurality of rods.

3. The apparatus of claim 2, wherein each rod is a distance $r_0$ from the central axis, where $r_0$ is an inscribed radius of the multipole portion, and wherein each ring has an inner radius $r_i$, and wherein the angularly spaced through-holes are spaced apart by an angular center-to-center separation $\theta$, and wherein a perimeter of each angularly spaced through hole is located at a radial distance of less than $r_0$ from the central axis, and wherein the rings are spaced apart from each other by a distance d ranging from about $r_0$ to about $2r_i$.

4. The apparatus of claim 3, wherein the distance d between at least two adjacent rings in the ring stack portion is different from the distance d between other adjacent rings in the ring stack portion.

5. The apparatus of claim 3, wherein the distance d between adjacent rings in the ring stack portion is the same.

6. The apparatus of claim 2, wherein the plurality of rods are oriented parallel to the central axis.

7. The apparatus of claim 2, wherein the plurality of rods are oriented nonparallel to the central axis.

8. The apparatus of claim 2, wherein a portion of each rod of the plurality of rods is oriented parallel to the central axis and another portion of each rod of the plurality of rods is oriented non parallel to the central axis.

9. The apparatus of claim 2, wherein each rod of the multipole portion has a cross section shape that is circular, oval, semi-circular, concave, flat, square, rectangular, hyperbolic, or multisided.

10. The apparatus of claim 2, further comprising a power source that comprises:

an RF voltage source connected to the multipole portion for supplying an RF voltage; and a DC voltage source connected to the ring stack portion for supplying a DC voltage.

11. The apparatus of claim 10, wherein for an even number of rods, the RF voltage source supplies the RF voltage to each rod, wherein the RF voltage supplied to adjacent rods is 180 degrees out of phase.

12. The apparatus of claim 11, wherein the RF voltage supplied to at least one rod has a different magnitude.

13. The apparatus of claim 11, wherein the RF voltage supplied to each rod has the same magnitude.

14. The apparatus of claim 10, wherein the RF voltage source comprises a DC bias source for supplying a DC offset voltage.

15. The apparatus of claim 14, wherein for an even number of rods, the RF voltage source supplies the RF voltage to every other rod and supplies the DC offset voltage to each of the rods.

16. The apparatus of claim 15, wherein the DC offset voltage to each rod is about zero volts.

17. The apparatus of claim 10, wherein for an even number of rods, the RF voltage source supplies the RF voltage to every other rod and the rods that are not supplied the RF voltage are at a ground potential.

18. The apparatus of claim 10, wherein for an odd number of rods, the RF voltage source supplies RF voltages having an odd number of phases to the rods, such that the RF voltages with consecutive phases are not applied to adjacent rods.

19. The apparatus of claim 10, wherein the DC voltage source comprises a DC voltage bias network that supplies a set of different DC voltages, wherein each of the different DC voltages is supplied to a different one of the rings in the ring stack portion thereby producing the DC electric field to accelerate the ions along the central axis.

20. The apparatus of claim 19, wherein the DC field is approximately constant along the central axis.

21. The apparatus of claim 19, wherein the DC field is increasing along the central axis.

22. The apparatus of claim 19, wherein the DC field is decreasing along the central axis.

23. The apparatus of claim 19, wherein the set of DC voltages is determined by $$E(z)=Az^m+B$$

where E(z) is an electric field strength along the central axis oriented parallel to a z-axis of a Cartesian coordinate system; B is an electric field strength that is independent of z and may be zero; A is a coefficient having scalar quantity used to adjust the overall magnitude of the electric field; and m is between minus three and three.

24. The apparatus of claim 19, wherein the set of DC voltages further comprises a retarding voltage, wherein the retarding voltage is applied to a ring closest to the input end to initially slow the motion of the ions.

25. The apparatus of claim 1, wherein the central axis is linear.

26. The apparatus of claim 1, wherein the central axis is nonlinear.

27. The apparatus of claim 26, where in the central axis follows a path that is a smooth curved line or a bent path.

28. The apparatus of claim 1, wherein a portion of the central axis is linear and another portion of the central axis is nonlinear.

29. The apparatus of claim 1, wherein the multipole portion is electrically insulated from the ring stack portion.

30. A mass spectrometer system comprising an ion source for providing analyte ions, a mass spectrometer, a pressure transition stage to transition the pressure from a high value at the ion source to a lower value at the mass spectrometer and an ion detection system, wherein the pressure transition stage comprises an ion guide having a central axis, an input end and an output end, wherein the ion guide further comprises:

a multipole portion;

a ring stack portion extending inside the multipole portion, wherein the multipole portion is electrically insulated from the ring stack portion, and a power source comprising:

a RF voltage source connected to the multipole portion to produce an RF field that confines the ions to a region around the central axis; and a DC voltage source connected to the ring stack portion to produce a DC electric field oriented along the central axis for accelerating ions from the input end to the output end.

31. The mass spectrometry system of claim 30, wherein the multipole portion comprises a plurality of rods oriented with respect to the central axis, and the ring stack portion comprises a plurality of spaced apart rings in a stacked relationship along the central axis, each ring having an inner through-hole aligned with the central axis, and a plurality of angularly spaced apart through-holes, each angularly spaced through hole for receiving a different one of the plurality of rods.

32. The mass spectrometry system of claim 31, wherein the plurality of rods is oriented parallel or non parallel to the central axis.

33. The mass spectrometry system of claim 31 wherein a portion of each rod of the plurality of rods is oriented parallel to the central axis and another portion of each rod of the plurality of rods is oriented non-parallel to the central axis.

34. The mass spectometry system of claim 31, wherein each rod is a distance $r_0$ from the central axis, where $r_0$ is an inscribed radius of the multipole portion, and wherein each ring has an inner radius $r_i$, the angularly spaced through-holes are located at an angular center-to center separation θ and a perimeter of each angularly spaced through hole is a radial distance less than $r_0$ from the central axis, and wherein the rings are spaced apart by a distance d ranging from about $r_0$ to about $2r_i$.

35. The mass spectrometry system of claim 34, wherein the distance d between at least two adjacent rings is different from the distance d between other adjacent rings of the ring stack portion.

36. The mass spectrometry system of claim 34, wherein the distance d between adjacent rings of the ring stack portion is the same.

37. The mass spectrometry system of claim 31, wherein for an even number of rods, the RF voltage source supplies an RF voltage to each rod, wherein the RF voltage supplied to adjacent rods is 180 degrees out of phase.

38. The mass spectrometry system of claim 37, wherein the RF voltage source supplies the RF voltage supplied to at least one rod has a different magnitude.

39. The mass spectrometry system of claim 37, wherein the RF voltage supplied to each rod has the same magnitude.

40. The mass spectrometry system of claim 31, wherein the RF voltage source supplies an RF voltage to each rod and comprises a DC bias source for supplying a DC offset voltage.

41. The mass spectrometry system of claim 40, wherein for an even number of rods, the RF voltage source supplies the RF voltage to every other rod and supplies the DC offset voltage to each of the rods.

42. The mass spectrometry system of claim 41, wherein the DC offset voltage to each rod is about zero volts.

43. The mass spectrometry system of claim 31, wherein for an even number of rods, the RF voltage source supplies the RF voltage to every other rod and the rods that are not supplied the RF voltage are at a ground potential.

44. The mass spectrometry system of claim 31, wherein for an odd number of rods, the RF voltage source provides RF voltages having an odd number of phases to the rods, wherein the RF voltages with consecutive phases are not applied to adjacent rods.

45. The mass spectrometry system of claim 31, wherein the DC voltage source comprises a DC voltage bias network that produces a set of different DC voltages, wherein a different DC voltage is applied to a different one of the rings in the ring stack portion thereby producing a DC field to accelerate the ions along the central axis.

46. The mass spectrometry system of claim 45, wherein the set of DC voltages further comprises a retarding voltage, wherein the retarding voltage is applied to a ring closest to the input end to initially slow the motion of the ions.

47. The mass spectrometry system of claim 30, wherein the central axis is linear or nonlinear.

48. The mass spectrometry system of claim 30, wherein a portion of the central axis is linear and another portion of the central axis is nonlinear.

49. The mass spectrometry system of claim 30, further comprising one or more sequential pressure transition stages adjacent to the first-mentioned pressure transition stage, wherein the ion guide extends through the first stage and the sequential stage(s).

50. The mass spectrometry system of claim 49, wherein the ring stack portion further comprising a partitioning ring between each stage, wherein an inner through hole through the partitioning ring limits gas conductance between stages.

51. A method of transporting ions from an ion source to a mass spectrometer using an ion guide that has a central axis, an input end, and an output end, wherein the ion guide further comprises:

a multipole portion;

a ring stack portion extending inside the multipole portion, wherein the multipole portion is electrically insulated from the ring stack portion, and a power source comprising:

a RF voltage source connected to the multipole portion to produce an RF field; and a DC voltage source connected to the ring stack portion to produce a DC electric field, wherein the method comprises the steps of:

focusing the ions with the RF field by confining the ions to a region around the central axis; and accelerating the ions along the central axis from the input end to the output end with the DC field.

52. The method of claim 51, wherein the multipole portion comprises a plurality of rods oriented with respect to the central axis, and the ring stack portion comprises a plurality of spaced apart rings in a stacked relationship along the central axis, each ring having an inner through-hole aligned with the central axis, and a plurality of angularly spaced apart trough-holes, each angularly spaced through-hole for receiving a different one of the plurality of rods.

53. The method of transporting ions of claim 52, wherein for an even number of rods, the step of focusing the ions comprises the steps of:

supplying an RF voltage to each rod, wherein the RF voltage supplied to adjacent rods is 180 degrees out of phase.

54. The method of transporting ions of claim 53, wherein the RF voltage supplied to at least one rod is of a different magnitude.

55. The method of claim 53, wherein the RF voltage supplied to each rod is of a same magnitude.

56. The method of claim 52, wherein the RF voltage source supplies an RF voltage and comprises a DC bias source for supplying a DC offset voltage.

57. The method of claim 56, wherein the step of focusing comprises the steps of:

supplying the RF voltage to every other rod; and supplying the DC offset voltage to each of the rods.

58. The method of claim 57, wherein the DC offset voltage supplied to each rod is about zero volts.

59. The method of claim 52, wherein for an even number of rods, the step of focusing comprises the steps of:

supplying an RF voltage to every other rod; and holding the rods that are not supplied the RF voltage at a ground potential.

60. The method of claim 52, wherein for an odd number of rods, the step of focusing comprises the step of:

supplying RF voltages having an odd number of phases to the rods, wherein the RF voltages with consecutive phases are not supplied to adjacent rods.

61. The method of claim 52, wherein the DC voltage source comprises a DC voltage bias network that produces a set of different DC voltages, and wherein the step of accelerating comprises the steps of:

supplying a different DC voltage to each different one of the rings in the ring stack portion.

62. The method of claim 61, wherein the set of DC voltages further comprises a retarding voltage, and the step of accelerating further comprises the step of:

supplying the retarding voltage to a ring closest to the input end to initially slow the motion of the ions.

63. A multi-stage mass/charge analysis system having a first stage and a last stage at a first pressure and a middle stage comprising an ion dissociation system for fragmenting the ions into daughter ions at a second pressure, the first pressure being relatively lower than the second pressure, the ion dissociation system comprising an ion guide that has a central axis, an input end, an output end and that further comprises:

a multipole portion;

a ring stack portion extending inside the multipole portion, wherein the multipole portion is electrically insulated from the ring stack portion, and a power source comprising:

an RF voltage source connected to the multipole portion to produce an RF field that confines the ions to a region around the central axis; and a DC voltage source connected to the ring stack portion to produce a DC electric field oriented along the central axis for accelerating ions from the input end to the output end.

64. The multi-stage analysis system of claim 63, wherein the first stage and the last stage are individually a quadrapole mass filter, an ion trap, a time-of-flight instrument or a magnetic sector spectrometer.

65. The multi-stage analysis system of claim 63, wherein the middle stage is maintained at the second pressure for dissociating ions with a gas selected from one or more of nitrogen or argon.

66. An ion guide apparatus having an input end for accepting ions and an output end for ejecting ions and having a central axis extending from the input end to the output end comprising;

a multipole portion; and a ring stack portion extending inside the multipole portion, each ring in the ring stack portion having a central hole aligned with the central axis, the central hole having an inner radius with respect to the central axis, and each ring having a plurality of through-holes for receiving the multipole portion, the multipole portion having an inscribed radius with respect to the central axis, wherein each ring of the, ring stack portion extends inside the multipole portion by an amount based on a difference between the inscribed radius and the inner radius.

* * * * *